US010621814B2

(12) United States Patent
Elias et al.

(10) Patent No.: US 10,621,814 B2
(45) Date of Patent: Apr. 14, 2020

(54) SYSTEMS AND METHODS FOR TRIGGERING A WILD REEL IN AN ELECTRONIC GAME INTERFACE

(71) Applicant: Raxor Gaming Limited, London (GB)

(72) Inventors: Hans Elias, Hertfordshire (GB); Alexander Sandford Todd Young, London (GB)

(73) Assignee: Roxor Gaming Limited, London (GB)

( * ) Notice: Subject to any disclaimer, the term of this patent is extended or adjusted under 35 U.S.C. 154(b) by 0 days.

(21) Appl. No.: 15/926,062

(22) Filed: Mar. 20, 2018

(65) Prior Publication Data

US 2018/0211478 A1 Jul. 26, 2018

Related U.S. Application Data

(63) Continuation of application No. 14/499,085, filed on Sep. 26, 2014, now Pat. No. 9,922,490, which is a continuation of application No. PCT/IB2014/000423, filed on Feb. 21, 2014.

(60) Provisional application No. 61/768,396, filed on Feb. 22, 2013.

(51) Int. Cl.
*G07F 17/32* (2006.01)
*G07F 17/34* (2006.01)

(52) U.S. Cl.
CPC ..... *G07F 17/3213* (2013.01); *G07F 17/326* (2013.01); *G07F 17/34* (2013.01); *G07F 17/3267* (2013.01)

(58) Field of Classification Search
None
See application file for complete search history.

(56) References Cited

U.S. PATENT DOCUMENTS

| | | | |
|---|---|---|---|
| 6,910,962 | B2 | 6/2005 | Marks et al. |
| 7,144,322 | B2 | 12/2006 | Gomez et al. |
| 7,553,231 | B2 | 6/2009 | Rodgers et al. |
| 7,749,063 | B2 | 7/2010 | Belger et al. |
| 8,105,145 | B2 | 1/2012 | Jaffe |

(Continued)

FOREIGN PATENT DOCUMENTS

WO WO2008082539 7/2008

OTHER PUBLICATIONS

Written Opinion for PCT/IB2014/000423 dated Sep. 3, 2014; 4 pp.

(Continued)

*Primary Examiner* — Damon J Pierce
(74) *Attorney, Agent, or Firm* — Fincham Downs LLC; Magdalena M. Fincham

(57) ABSTRACT

Certain embodiments provide for replacing all regular symbols located in respective symbol positions comprising a predetermined set of symbol positions of a symbol matrix (e.g., all the regular symbols on a reel of a reeled slot machine-type game) with at least one special symbol (e.g., a wild symbol which may be output as taking up the entirety of the reel) if the predetermined set of symbol positions (e.g., the symbol positions comprising the reel) satisfy a qualifying condition. In one embodiment the qualifying condition is that a threshold number of symbols have been removed from (or replaced on) the predetermined set of symbol positions within a predetermined timeframe or game event (e.g., that a threshold number of symbols have been removed from a particular reel during a cascade feature).

18 Claims, 17 Drawing Sheets

(56) References Cited

U.S. PATENT DOCUMENTS

| | | | | |
|---|---|---|---|---|
| 8,152,623 | B2 | 4/2012 | Fiden | |
| 8,177,622 | B2 | 5/2012 | Englman | |
| 8,192,272 | B2 | 6/2012 | Thomas et al. | |
| 8,192,275 | B2 | 6/2012 | Aoki et al. | |
| 8,246,447 | B2 | 8/2012 | Gauselman | |
| 8,251,798 | B2 | 8/2012 | Belger et al. | |
| 8,366,538 | B1 | 2/2013 | Saunders et al. | |
| 8,414,380 | B2 | 4/2013 | Saunders et al. | |
| 8,430,737 | B2 | 4/2013 | Saunders | |
| 8,454,429 | B2 | 6/2013 | Jaffe et al. | |
| 8,512,138 | B2 | 8/2013 | Saunders | |
| 8,523,659 | B2 | 9/2013 | Evans | |
| 2004/0043809 | A1* | 3/2004 | Gomez | G07F 17/32 463/16 |
| 2004/0072612 | A1 | 4/2004 | Rodgers et al. | |
| 2006/0073876 | A1 | 4/2006 | Cuddy | |
| 2008/0032784 | A1 | 2/2008 | Englman | |
| 2008/0108413 | A1 | 5/2008 | Gelber et al. | |
| 2008/0132309 | A1 | 6/2008 | Baumgartner et al. | |
| 2009/0111566 | A1 | 4/2009 | Naicker et al. | |
| 2010/0004050 | A1 | 1/2010 | Caputo et al. | |
| 2010/0062827 | A1 | 3/2010 | Hoffman et al. | |
| 2011/0111830 | A1 | 5/2011 | Seelig et al. | |
| 2012/0238348 | A1 | 9/2012 | Aoki et al. | |
| 2012/0295688 | A1 | 11/2012 | Watkins et al. | |
| 2013/0035154 | A1 | 2/2013 | Watkins et al. | |
| 2013/0190067 | A1 | 7/2013 | Saunders | |

OTHER PUBLICATIONS

International Search Report for PCT/IB2014/000423 dated Sep. 3, 2014; 8 pp.

International Preliminary Report on Patentability for PCT/IB2014/000423 dated Aug. 25, 2015; 5 pp.

Office Action for U.S. Appl. No. 14/499,085 dated Nov. 17, 2016; 17 pp.

Final Office Action for U.S. Appl. No. 14/499,085 dated Jun. 23, 2017; 18 pp.

Notice of Allowance for U.S. Appl. No. 14/499,085 dated Nov. 13, 2017; 5 pp.

* cited by examiner

SYSTEMS AND METHODS FOR TRIGGERING A WILD REEL IN AN ELECTRONIC GAME INTERFACE

CLAIM OF PRIORITY

The present application is a continuation-in-part application of U.S. application Ser. No. 14/499,085 filed on Sep. 26, 2014 in the name of Elias et al. and titled SYSTEMS AND METHODS FOR PLACEMENT OF WILD SYMBOLS IN A GAME. Application Ser. No. 14/499,085 is a continuation of International Application PCT/IB2014/000423, with an international filing date of Feb. 21, 2014 and titled SYSTEMS AND METHODS FOR PLACEMENT OF WILD SYMBOLS IN A GAME, filed in the name of Elias et al.; which PCT application claims the benefit of priority of U.S. Provisional Application No. 61/768,396, filed Feb. 22, 2013 in the name of Elias et al. and titled SYSTEMS AND METHODS FOR REPLACING REGULAR SYMBOLS WITH WILD SYMBOLS IN A GAME BASED ON A QUALIFYING EVENT. The entirety of each of these applications is incorporated by reference herein for all purposes.

FIELD OF THE INVENTION

At least some embodiments described herein relate to electronic games (e.g., such as online wagering games) and particularly to methods and systems for placement of wild symbols (e.g., stacked wild symbols) during the game.

DETAILED DESCRIPTION OF EXAMPLE EMBODIMENTS

I. Introduction

Figure 1:
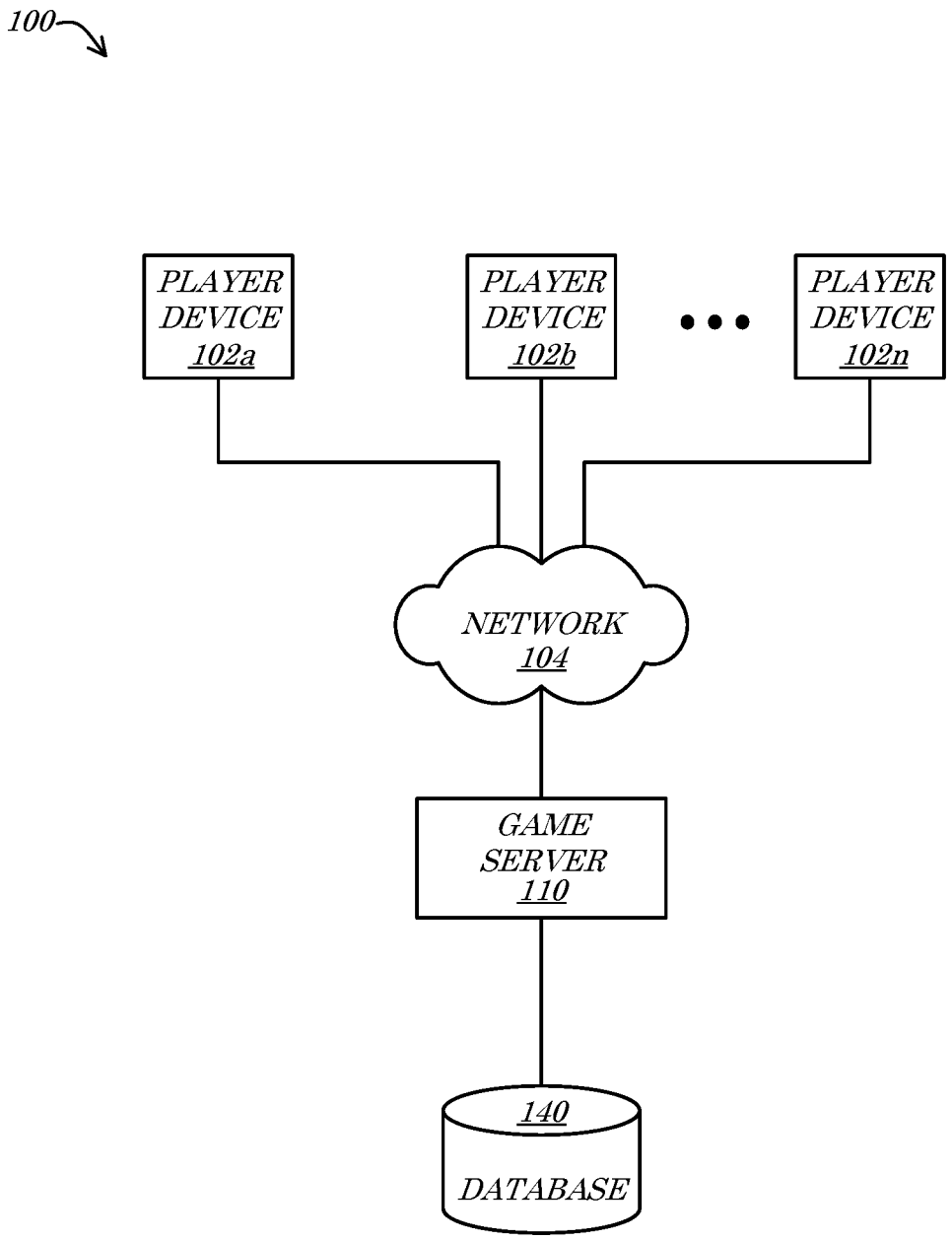
FIG. 1 is a schematic diagram of an embodiment of a gaming system in accordance with one or more embodiments described herein.

Games, whether wagering or non-wagering, are a popular past-time for millions of people all over the world. Electronic games in particular are becoming more and more popular, particularly ones playable online using a computer connected to a network. For example, according to some reports more than 200 million people play social games every month and online games recently passed e-mail as the second-most popular activity online, second only behind social networking. Accordingly, there is a need to continue to create exciting electronic games which maintain players' interest and stand out from the multitude of available online games.

Various "reel-type" or reeled slot machine games are popular with many players, whether deployed on dedicated gaming devices (e.g., a traditional slot machine device in a casino, operable primarily to facilitate one or more slot machine games) or on non-dedicated computing devices (e.g., personal computers, mobile devices, laptops or table computers, which are operable to perform a variety of functions in addition to supporting reeled slot machine games). A reeled slot machine game typically includes a plurality of reels, each reel including a plurality of symbol positions for display of a reel symbol. A symbol is a visual representation of an element or indicia used in the game to determine whether the player qualifies for an award. A reel symbol is a symbol output on a reel of a game interface. The term "symbol" as used herein may refer to a reeled symbol or a symbol of another type of game that is not a reel-type slot machine game (e.g., a game consisting of a grid, such as a bingo game, or any other type of interface that may be applied to embodiments described herein). A reel may be mechanical (e.g., in a physical dedicated gaming device on a casino floor) or virtual (e.g., a software representation of a reel on an electronic display of a dedicated or non-dedicated device). In a reel-type slot machine game the reels spin (or representations of virtual reels are made to look as if they spin) after a player places a wager on the game, provides another qualifying input or another reel-initiation event occurs. The reels then stop to display generated combinations of symbols on the reels.

It should be noted that embodiments described herein are not limited to reel-type slot machine games. For example, the embodiments may be implemented in a card game (e.g., a multi-hand video poker game), a grid type game (e.g., a bingo game) or any type of game in which representations of outcomes are output in a configuration which lends itself to the wild symbol game mechanic described herein. Thus, it should be noted that although the term "spin" is used to refer to a game event which results in an outcome, the term "spin" is intended to encompass any type of game event (not limited to a game event in a reel-type slot machine game) for which an outcome may be determined.

The "outcome" of a spin or other type of game event, as the term is used herein, is the set of symbols as displayed in a set of symbol positions which are evaluated to determine whether the spin results in an award or prize. In a reel-type slot machine game, an outcome of a spin may refer to the symbols displayed along symbol positions comprising one or more paylines of the game. If a generated symbol or combination of symbols is a winning symbol or combination of symbols (i.e., a symbol or combination of symbols associated with an award), the award corresponding to the winning symbol or winning symbol combination is provided or output (e.g., if the generated winning symbol or winning combination of symbols appears along an active payline associated with the reels or in a scatter pay of a reel-type slot machine game). The symbols along a payline at the end of a spin (i.e., once the reels are stopped and the symbols in the symbol positions are positioned such that a player may determine whether he/she qualifies for an award as a result of the spin) are referred to as the "outcome of the payline" herein. Thus, an outcome of a spin may comprise one or more outcomes of paylines. Further, an outcome of a payline may include a winning combination of symbols along with one or more additional symbols. For example, in a five (5) reel slot machine game, a payline may include five (5) symbol positions (e.g., one symbol position in each reel of the 5 (five) reels). However, one or more possible winning combinations of symbols may comprise three (3) or four (4) symbol combinations such that an occurrence of a winning combination of symbols along the payline will include the symbols comprising the winning combination as well as additional symbols that, while not part of the winning combination of symbols, are also along the payline and thus included in the outcome of the payline. For example, assume an occurrence of three (3) cherry symbols along a payline in a fruit-themed five (5) reel slot machine type game corresponds to an award of two (2) credits and an outcome of a spin includes the following symbols in the symbol positions comprising that payline: cherry-cherry-lemon-orange-cherry. In accordance with rules of one particular example game, the award corresponding to the three cherry symbols along the payline may be awarded to the player and the three cherry symbols may be referred to as the winning combination of symbols while the lemon and orange symbols are not part of the winning combination of symbols but are still part of the outcome of the payline. Such symbols which are part of an outcome of a payline but not symbols which are part of a winning combination of a payline are referred to herein as non-qualifying symbols herein. The symbols which are part of the winning combination and comprise the outcome of the payline are referred to as qualifying symbols herein for purposes of this embodiment. In other embodiments, a qualifying symbol is a symbol which qualifies for replacement with a special symbol, such as a wild symbol, in accordance with the rules of the game.

One game feature available in some reeled games is the use of one or more wild symbols in some particular manners. A wild symbol is a symbol which may be placed in a symbol position of a reel and which changes, replaces or functions as one of the regular symbols on one of the reels (e.g., a wild symbol may be treated as equivalent to any of the regular symbols of the game). In some games a wild symbol is made to replace a regular symbol after the reels stop and an initial outcome for a payline or spin is displayed while in other game a wild symbol may be utilized on a reel to replace a regular symbol on a reel prior to any initial payline outcome being displayed to a player. Use of a wild symbol in a game enables, for example, changing of a first or non-winning combination of symbols to a second and possibly winning combination of symbols (e.g., to make a winning combination or align a winning combination on an active payline) by replacing a regular symbol with a wild symbol in order to create a winning combination of symbols, thus increasing additional opportunities for winning combinations. Applicant has recognized that there is a continuing need for new ways of utilizing wild symbols in a reeled slot machine game to create added excitement and reward opportunities within the game.

Described herein is a particular "wild symbol feature" applicable to any game (e.g., a reeled slot-machine type game) in which payouts are awarded for certain pre-determined combinations of symbols appearing along paylines of the game (e.g., for winning combinations of symbols along paylines comprising symbol positions across a plurality of the reels). In accordance with some embodiments, all the symbols on a particular reel (or all the symbol positions visible to a player of a game interface on which the reels are displayed a player of the game) are replaced with wild symbols (and, e.g., paylines are re-evaluated to determine whether additional winning combinations have been created as a result of the replacing) when a predetermined qualifying event is determined to have occurred in the game. Various types of predetermined qualifying events may be implemented and the present disclosure is not limited to any particular type of qualifying event.

In one embodiment, the qualifying event may be that each of the symbols in the symbol positions comprising the reel is part of at least one winning combination of symbols (e.g., that each of the symbols on the reel is a qualifying symbol). Thus, determining that a qualifying event has occurred in the game may comprise determining that each of the symbols on the reel is a qualifying symbol, each qualifying symbol being part of at least one winning combination of symbols. In such embodiments, it may be insufficient (for a reel to be determined to be a qualifying or winning reel) if at least one symbol on the subject reel is along an outcome of a payline which includes a winning combination of symbols but is itself a non-qualifying symbol. FIGS. 5A through 5F and 6A through 6B illustrated example implementations of such a predetermined qualifying event.

In another example embodiment, determining that a predetermined qualifying event has occurred in the game may comprise determining for a given reel (e.g., after an outcome for a spin is determined), that each of the symbols of the reel (or each of the symbols in symbol positions visible to a player of a game interface on which the reels are displayed) is a part of an outcome along a payline that includes a winning combination. For example, for a given symbol on the reel it may be true, but is not required to be true, that the symbol is part of that winning combination and thus a qualifying symbol. Just being part of an outcome of a payline which includes a winning combination may be sufficient for the symbol to count towards the reel on which it is positioned to be considered a qualifying reel. Other examples of predetermined qualifying events may be appreciated by one of ordinary skill in the art after reading the present disclosure.

In some embodiments in which a reel is determined to be a qualifying reel based on whether each symbol on the reel is a qualifying symbol, determining whether a qualifying event has occurred is a multi-step determination. Such a determination may include, for example: (i) determining whether each symbol of a subject reel is a qualifying symbol (or at least part of at least one outcome of a payline which includes a winning combination of symbols, depending on the embodiment being implemented); and (ii) determining that each such payline is an active payline for which an award is to be provided to a player (e.g., the outcome(s) of the payline(s) determined in (i) are along paylines for which the player provided a wager and will thus receive a payout). If, in the latter embodiment, the result of each determination (i) and (ii) is affirmative, then the reel is determined to be a qualifying or winning reel. In either embodiment, once a reel is identified as a qualifying (i.e., winning) reel because it has satisfied the one or more conditions of the qualifying event, each of the symbols in the symbol positions comprising the qualifying reel is replaced with a wild symbol.

Thus, in accordance with at least one embodiment, a reel on which each of the symbols in the symbol positions comprising the reel are along a payline which qualifies the player for an award (i.e., because a winning combination of symbols appears along the payline) is referred to as a "qualifying reel" or "winning reel" herein and each of the symbols on that reel are replaced with a wild symbol. In some embodiments, each of the symbols may be replaced with a respective wild symbol such that there are multiple wild symbols shown as a result of the replacing, each in one of the respective symbol positions of the reel. In another embodiment, a single wild symbol which stretches vertically down the reel replaces what would otherwise be multiple symbols in multiple symbol positions along the reel. In the latter embodiment, the single wild symbol stretching down the reel may be treated as a wild symbol for purposes of each individual symbol position comprising a payline along the reel.

As described herein, in some embodiments additional symbols in additional symbol positions (i.e., in symbol positions which are not part of the qualifying reel) of the game interface may also be replaced with wild symbols or other regular symbols (e.g., the symbols above them in the reel if a cascade feature is utilized in the game). Any symbol position which qualifies for a symbol thereon being replaced with a wild symbol or a different regular symbol after an initial resolution of a spin (irrespective of whether the symbol position is part of a qualifying reel) is referred to as a qualifying symbol position herein. Upon all replacements being completed for any qualifying symbol positions, the paylines (e.g., all paylines or only the active paylines, depending on the embodiment) of the game are re-evaluated to determine whether the player qualifies for any additional awards based on the replacements. In one embodiment, no additional wager is received from the player for this additional re-evaluation of the paylines and providing of award (i.e., the player's wager for the original spin or game event which resulted in one or more winning combinations that caused symbols to be replaced also qualifies the player to receive any awards resulting from the replacements in accordance with the rules of the game).

Replacing all the symbols in each of the symbol positions of a qualifying reel with wild symbols (or a single wild symbol that applies to, or stretches down, the entire reel) may result in additional winning opportunities for a player which may not otherwise be available to the player in other more simplified wild symbol game mechanics which do not incorporate the qualifying reel concept. For example, in some embodiments a game which may already provide a simple wild symbol mechanic in which a regular symbol which is part of a winning combination upon a resolution of a spin (i.e., a qualifying symbol) may be replaced with a wild symbol and the paylines re-evaluated for additional winning combinations (e.g., for no additional wager beyond the wager provided for the original spin) may be modified to provide yet more winning opportunities with the use of the qualifying reel wild feature described herein. For example, consider a game employing a wild symbol game mechanic in which it is only the symbols which actually contribute to the symbol combination being a winning combination that are replaced with wild symbols (i.e., symbols appearing in symbol positions along the payline, which are part of the outcome of the payline but are not part of the winning combination of symbols are not replaced with wild symbols). In a yet more particular example, consider a game in which an award is provided upon three (3) or more matching symbols occurring along an active payline, wherein the payline consists of five (5) symbol positions. In accordance with some embodiments, if upon resolution of the spin there are four (4) matching symbols along the payline (thus resulting in an award being provided to the player), only the four (4) matching symbols along that payline may be replaced with respective wild symbols, the regular symbol in the fifth symbol position of the payline which is not part of the winning combination being maintained and not replaced with a wild symbol. However, if the qualifying reel game mechanic described herein were added to the game and that fifth symbol position comprising the regular symbol along the subject payline is part of the qualifying reel, that regular symbol would be replaced with a wild symbol (e.g., a stacked wild symbol which stretches vertically down the reel, being applied to all symbol positions of the reel visible to the player) because it is along a payline which contributes to the reel being considered a qualifying reel, even if it did not otherwise qualify for replacement with a wild symbol because it was not part of the winning combination of symbols comprising the outcome of the payline.

It should be noted, as alluded to above, that determining whether "all" the reel positions of a reel include symbols which are part of a winning combination and replacing the symbols in such reels positions of the reel with wild symbols may comprise evaluating the symbols in the reel positions visible to the player of the game as displayed on a game interface of the game (i.e., only the symbol positions along paylines of the game). In some embodiments, replacing the regular symbols of a reel with wild symbols may comprise replacing (i) all the symbols in all the reel positions of the reel with the wild symbols; or (ii) all the symbols on reel positions visible to a player of the game as displayed on a game interface of the game. It should further be noted that "replacing" a regular symbol with a wild symbol may comprise any manner or methodology for causing a symbol position to indicate that it is now associated with a wild symbol and usage of this term throughout the present description is not intended to limit the scope of the embodiments to a traditional "replacement" in which the regular symbol is removed from the symbol position and a wild symbol is placed in the symbol position in its stead. In some embodiments, for example, "replacing" a regular symbol with a wild symbol may comprise superimposing a semi-transparent image of a wild symbol on the regular symbol, placing a depiction of the wild symbol near the regular symbol in the symbol position and/or causing the symbol position to otherwise be designated as corresponding to a wild symbol, such as by highlighting, shading, animating or otherwise altering the symbol position.

In accordance with some embodiments, after all the regular symbols on a winning reel are replaced with wild symbols, the paylines of the game are re-evaluated for the current spin to determine whether any new or additional winning combinations have been created along the paylines as a result of the replacing. In some embodiments, only the paylines the player bet on when initiating the spin (i.e., the "active" paylines for the spin) may be evaluated in the re-evaluating step after the replacement of the symbols with the wild symbols. In other embodiments, all paylines may be evaluated for winning combinations after the replacing step. In some embodiments, the replacing step may be iterative such that, after the re-evaluating of the paylines, it is again determined whether any reel consists of symbols each of which are part of a winning combination and, if this is a reel the symbols of which were not previously replaced, the regular symbols of this newly identified qualifying reel are replaced by wild symbols and the re-evaluating of the paylines is again performed. In other embodiments, a wild symbol (or at least the wild symbol(s) which had replaced the regular symbols on the qualifying reel) are only maintained for one additional spin, cascade or win re-evaluation.

In accordance with some embodiments, the wild symbols which replaced the regular symbols of the qualifying reel are maintained on the symbol positions of the qualifying reel for at least one subsequent spin. In such embodiments, the wild symbols may not impact any payout or bonus for the spin which caused the wild symbols to replace the regular symbols (i.e., in some embodiments the paylines are not re-evaluated for winning combinations after the replacing but before an initiation of a subsequent spin). In other embodiments, the paylines may be re-evaluated for winning combinations AND the wild symbols may be maintained on the qualifying reel for at least one subsequent spin.

In some embodiments, if multiple reels consist of symbols each of which are part of winning combinations (a situation with multiple qualifying reels), each of the regular symbols on each of the qualifying reels may be replaced with wild symbols.

In some embodiments, a cascading model may be employed such that the wild symbols replacing the regular symbols stay in position for the next cascade or spin and then are removed from the symbol matrix even if they were not part of winning combinations.

One or more embodiments comprise a method (as well as systems and articles of manufacture (such as non-transitive computer readable media which cause a processor of a computing device to perform said method)) which provides for (a) providing a game interface comprising a plurality of symbol positions, the plurality of symbol positions arranged in a plurality of rows and a plurality of columns, each column of the plurality of columns representing a reel of a slot-machine type game, wherein the game further comprises a plurality of paylines, each payline comprising a plurality of symbol positions across a plurality of columns, and further wherein a winning outcome of a payline comprises a winning combination of symbols being displayed, upon a resolution of a game event, in at least a subset of the symbol positions comprising the payline of the plurality of paylines; (b) outputting an outcome for a first game event based on an initial wager, thereby effectuating a resolution of the first game event; (c) identifying, for each payline of the game comprising the outcome of the first game event, whether symbols displayed in the symbol positions comprising the payline comprise a winning outcome of the payline; (d) causing, for each identified winning outcome of a payline, a corresponding payout to be awarded to a player currently playing the game; (e) determining, for the particular game event and for a particular column of the game interface, that each symbol position comprising the column has displayed thereon a symbol which is part of at least one winning outcome of at least one payline identified in (c), thereby identifying a qualifying reel; and (f) replacing, on the qualifying reel, each of the symbols with at least one special symbol.

In one embodiment, the qualifying event that may cause a determination that a reel is a qualifying reel may involve tracking of symbols removed from (or symbols that replace other symbols on the reel) during a particular timeframe (e.g., during a reel cascade feature of a game). Such tracking of removed symbols or replacement symbols may be done instead of or in addition to determining whether every symbol on a reel is a qualifying symbol. For example, in one embodiment the qualifying event that causes a reel to be considered a qualifying reel may be that a minimum or threshold number of symbols have been removed from (or replaced on) the reel.

In accordance with some embodiments, a running count of symbols removed from a reel (or replaced on the reel) is maintained for each reel of a game and once the running count for a particular reel reaches (or, in some embodiments, exceeds) a predetermined number or threshold, that reel is determined to be a qualifying reel. For example, as described herein, in some embodiments a cascade feature may be triggered or initiated based on a game event and, during the cascade feature, symbols may be removed (e.g., symbols that are part of a winning combination may be removed once the player is provided a payout for that winning combination) from the reel and replaced (e.g., with a symbol directly above the removed symbol on the same reel). A count of removed symbols (or symbols that have been replaced) is referred to as a removed symbol count. It should be noted that a similar game mechanic may track a running count of replacement symbols placed on the reel during a particular game event (e.g., during a cascade feature).

In accordance with some embodiments, once a removed symbol count for a particular reel reaches or exceeds a threshold count, the reel is considered a qualifying reel and all symbols on that reel are replaced with a stacked wild symbol or another wild symbol as described herein for other embodiments in which a qualifying reel is identified. The removed symbol count for that reel may be reset to a default number (e.g., zero) and the cascade feature continued (e.g., such that the count for removed symbols for another reel may also subsequently reach the threshold number and thus cause another of the reels to be determined to be a qualifying reel).

It should be noted that the threshold number that, once reached or exceeded in a removed symbol count, may be selected or set based on one or more factors. Examples of such factors include, without limitation: (i) the particular reel for which removed symbols are being tracked (e.g., different reels may have different threshold numbers associated therewith); (ii) an identity or characteristic of the player playing the game; (iii) a time and/or date on which the game is being played; (iv) a preference of the game manufacture or game operator (e.g., game operator may, at a time of its choosing, lower the threshold number to increase the chances that a reel may qualify as a qualifying reel); (v) a random determination by a processor of the game; (vi) a bonus or eligibility won or otherwise obtained by the player during play of the game; and (vii) a magnitude or frequency of wagers placed by the player. In some embodiments, each reel may correspond to the same threshold number for a particular game event or player while in other embodiments different reels may correspond to different threshold numbers.

Once a reel is determined to be a qualifying reel, it may implemented or behave in a manner similar to that described with respect to other embodiments. For example, stacked wild symbol does not persist for more than one cascade in some embodiments. In some embodiments, once the special symbol(s) that replaced one or more regular symbol on a qualifying reel are themselves removed and replaced, the removal of the special symbol(s) does not affect the removed symbol count for that reel (i.e., the removed special symbol (s) are not used to update/increase the removed symbol count for that reel). In other embodiments, the removal of the special symbol(s) may cause the removed symbol count for that reel to be increased.

In some embodiments, the likelihood or probability of a qualifying reel being determined as a result of a spin or other game event (e.g., the likelihood or probability that all the symbols on the reel are part of a winning combination of symbols) may be increased by utilizing a second process, which may be executed in addition to a first process for determining of an outcome for a spin and before the result of the spin is displayed to the player. The second process may, for example, comprise additional steps added to the process for determining an outcome for a spin or an independent process running essentially in parallel with (or after at least some steps of the first process are performed) the first process.

In some embodiments, such a first process for determining an outcome of a spin may comprise determining one or more outcomes (e.g., an outcome for each payline of the game and/or a symbol for each symbol position of the game) using a Random Number Generator (RNG), as would be understood by one of ordinary skill in the art. For example, at least one pseudo-random number generated by the RNG (e.g., based on an algorithm for generating pseudo-random numbers) may be determined for a particular spin, the at least one pseudo random number corresponding to particular symbols to appear in respective symbol positions visible to the player at the completion of the spin or to a total payout to be provided to the player as a result of the spin (and then selecting the symbols to display along active paylines for the spin in order to effectuate the total payout so determined). In some embodiments, a distinct pseudo-random number may be determined for at least one of (i) at least one active payline of the spin, (ii) at least one symbol position, and (iii) at least one reel (or other set of symbol positions in games which are not reel-based slot machine type of games). In either embodiment, the first process for determining an outcome of a spin may comprise determining, in some manner and based on an RNG, the symbols to be displayed on the symbol positions of each reel visible to the player at the completion of the spin. This first process (and variations thereof described above) would be understood by one of ordinary skill in the art.

The present disclosure contemplates, however, a second process which may be implemented in at least some embodiments of the invention(s) described herein. Such a second process may be employed to modify the symbols to be displayed (as determined by the first process) in the symbol positions of the game. For example, the second process may comprise determining that a stacked symbol (regular or wild) should be placed on a particular reel or determining a regular symbol to be substituted for one or more different regular symbols otherwise determined by the first process. In accordance with some embodiments, the second process may run or be executed essentially parallel to (e.g., run at the same time as) the first process for a given spin and the result of the first process may be overlaid or combined with the result of the first process before the reels stop spinning (i.e., prior to resolution of the spin), such that the outcome of the spin determined based on the first process is modified by a result of the second process.

Certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

Although several embodiments, examples and illustrations are disclosed below, it will be understood by those of ordinary skill in the art that the invention described herein extends beyond the specifically disclosed embodiments, examples and illustrations and includes other uses of the invention and obvious modifications and equivalents thereof. Embodiments of the invention(s) are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the invention(s). In addition, embodiments of the invention(s) can comprise several novel features and it is possible that no single feature is solely responsible for its desirable attributes or is essential to practicing the invention(s) herein described.

Throughout the description that follows and unless otherwise specified, the following terms may include and/or encompass the example meanings provided in this section. These terms and illustrative example meanings are provided to clarify the language selected to describe embodiments both in the specification and in the appended claims, and accordingly, are not intended to be limiting. Other terms are defined throughout the present description.

A "game", as the term is used herein unless specified otherwise, may comprise any game (e.g., wagering or non-wagering, electronically playable over a network) playable by one or more players in accordance with specified rules. A game may be playable on a personal computer online in web browsers, on a game console and/or on a mobile device such as a smart-phone or tablet computer. A game may also be playable on a dedicated gaming device (e.g., a slot machine in a brick-and-mortar casino). "Gaming" thus refers to play of a game.

A "casual game", as the term is used herein unless specified otherwise, may comprise a game with simple rules with little or no time commitment on the time of a player to play. A casual game may feature, for example, very simple game play such as a puzzle or Scrabble™ game, may allow for short bursts of play (e.g., during work breaks), an ability to quickly reach a final stage and/or continuous play without a need to save the game.

A "social network game", as used herein unless specified otherwise, refers to a type of online game that is played through a social network, and in some embodiments may feature multiplayer and asynchronous game play mechanics. A "social network" may refer to an online service, online community, platform, or site that focuses on facilitating the building of social networks or social relations among people. A social network service may, for example, consist of a representation of each user (often a profile), his/her social links, and a variety of additional services. A social network may be web-based and provide means for users to interact over the Internet, such as e-mail and instant messaging. A social network game may in some embodiments be implemented as a browser game, but can also be implemented on other platforms such as mobile devices.

A "wagering game", as the term is used herein, may comprise a game on which a player can risk a wager or other consideration, such as, but not limited to: slot games, poker games, blackjack, baccarat, craps, roulette, lottery, bingo, keno, casino war, etc. A wager may comprise a monetary wager in the form of an amount of currency or any other tangible or intangible article having some value which may be risked on an outcome of a wagering game. "Gambling" or "wagering" refers to play of a wagering game.

The term "game provider", as used herein unless specified otherwise, refers to an entity or system of components which provides, or facilitates the provision of, games for play and/or facilitates play of such game by use of a network such as the Internet or a proprietary or closed networks (e.g., an intranet or wide area network). For example, a game provider may operate a website which provides games in a digital format over the Internet. In some embodiments in which a game comprising a wagering game is provided, a game provider may operate or facilitate a gambling website over which wagers are accepted and results of wagering games are provided.

The terms "information" and "data", as used herein unless specified otherwise, may be used interchangeably and may refer to any data, text, voice, video, image, message, bit, packet, pulse, tone, waveform, and/or other type or configuration of signal and/or information. Information may comprise information packets transmitted, for example, in accordance with the Internet Protocol Version 6 (IPv6) standard as defined by "Internet Protocol Version 6 (IPv6) Specification" RFC 1883, published by the Internet Engineering Task Force (IETF), Network Working Group, S. Deering et al. (December 1995). Information may, according to some embodiments, be compressed, encoded, encrypted, and/or otherwise packaged or manipulated in accordance with any method that is or becomes known or practicable.

The term "indication", as used herein unless specified otherwise, may refer to any indicia and/or other information indicative of or associated with a subject, item, entity, and/or other object and/or idea. As used herein, the phrases "information indicative of" and "indicia" may be used to refer to any information that represents, describes, and/or is otherwise associated with a related entity, subject, or object. Indicia of information may include, for example, a code, a reference, a link, a signal, an identifier, and/or any combination thereof and/or any other informative representation associated with the information. In some embodiments, indicia of information (or indicative of the information) may be or include the information itself and/or any portion or component of the information. In some embodiments, an indication may include a request, a solicitation, a broadcast, and/or any other form of information gathering and/or dissemination.

The term "network component," as used herein unless specified otherwise, may refer to a user or network device, or a component, piece, portion, or combination of user or network devices. Examples of network components may include a Static Random Access Memory (SRAM) device or module, a network processor, and a network communication path, connection, port, or cable.

In addition, some embodiments are associated with a "network" or a "communication network". As used herein, the terms "network" and "communication network" may be used interchangeably and may refer to any object, entity, component, device, and/or any combination thereof that permits, facilitates, and/or otherwise contributes to or is associated with the transmission of messages, packets, signals, and/or other forms of information between and/or within one or more network devices. Networks may be or include a plurality of interconnected network devices. In some embodiments, networks may be hard-wired, wireless, virtual, neural, and/or any other configuration of type that is or becomes known. Communication networks may include, for example, one or more networks configured to operate in accordance with the Fast Ethernet LAN transmission standard 802.3-2002® published by the Institute of Electrical and Electronics Engineers (IEEE). In some embodiments, a network may include one or more wired and/or wireless networks operated in accordance with any communication standard or protocol that is or becomes known or practicable.

The term "player," as used herein unless specified otherwise, may refer to any type, quantity, and or manner of entity associated with the play of a game. In some embodiments, a player may comprise an entity (i) conducting play of an online game, (ii) that desires to play a game (e.g., an entity registered and/or scheduled to play and/or an entity having expressed interest in the play of the game—e.g., a spectator) and/or may (iii) that configures, manages, and/or conducts a game. A player may be currently playing a game or have previously played the game, or may not yet have initiated play—i.e., a "player" may comprise a "potential player" (e.g., in general and/or with respect to a specific game). In some embodiments, a player may comprise a user of an interface (e.g., whether or not such a player participates in a game or seeks to participate in the game).

Some embodiments described herein are associated with a "player device" or a "network device". As used herein, a "player device" is a subset of a "network device". The "network device", for example, may generally refer to any device that can communicate via a network, while the "player device" may comprise a network device that is owned and/or operated by or otherwise associated with a player. Examples of player and/or network devices may include, but are not limited to: a Personal Computer (PC), a computer workstation, a computer server, a printer, a scanner, a facsimile machine, a copier, a Personal Digital Assistant (PDA), a storage device (e.g., a disk drive), a hub, a router, a switch, and a modem, a video game console, or a wireless or cellular telephone. Player and/or network devices may, in some embodiments, comprise one or more network components.

A "session" comprises a period of time spanning a plurality of event instances, game instances, spins or turns of a game, the session having a defined start and defined end. An "event instance", "game instance", "session" or "turn" is triggered upon an initiation of, or request for, at least one result of the game by a player, such as an actuation of a "start" or "spin" mechanism, which initiation causes an outcome to be determined or generated (e.g., a random number generator is contacted or communicated with to identify, generate or determine a random number to be used to determine a result for the event instance). An event instance or turn may comprise an event instance or turn of a primary game or an event instance or turn of a bonus round, mode or feature of the game. Accordingly, a session may refer to a session of a primary game or a session of a bonus round, mode or feature of the game, depending on the context.

An "outcome" should be differentiated from a "result" in the present description in that an "outcome" is a representation of a "result", typically comprising one or more game elements or game symbols. For example, in a "fruit themed" game, a winning outcome (i.e., an outcome corresponding to some kind of award, prize or payout) may comprise a combination of three "cherry" symbols. The "result" of this outcome may be a payout of X credits awarded to the player associated with the game. In another example, in a game in which a character moves along a game interface from a starting position to a finish position, an "outcome" of the game may comprise a symbol representing one or more movements along the interface and the "result" corresponding to this outcome may be the particular number and direction of the character's movement (e.g., three spaces backwards such that the character ends up further away from the finish line). In a session embodiment, a session result may comprise a binary result (e.g., a player or game character wins or loses the session) and/or the particular award (or magnitude of award) won or earned by the player based on the session (e.g., the number of credits awarded to the player). It should be noted that the embodiments described herein encompass prizes which may comprise awards, payouts, discounts, eligibility, advancement in a game or other benefits (whether monetary or non-monetary, tangible or intangible) to a player and that any reference to a "prize", "award" or "payout" may refer to any or all of the foregoing, unless the context explicitly indicates otherwise.

A "bonus round", "bonus mode" or "bonus feature" of a game, as the terms are used interchangeably herein unless indicated otherwise, may refer to a secondary game, entry into which is triggered via one or more events which may occur in a base or primary game. Typically, a player may be able to qualify to play a bonus game based on one or more outcomes in a primary game, such as in a basic mode or a qualifying mode. A bonus round may be played in accordance with a set of rules that is different from those of a primary game, and may be accompanied by displays, colors, sounds, animated sequences, game play and/or prizes that are not part of the primary game. In one embodiment, a primary or base game application or program may include programming or instructions which will automatically begin a bonus round after the player has achieved a triggering event or qualifying condition in the base or primary game.

"Virtual currency" as the term is used herein unless indicated otherwise, refers to an in-game currency that may be used as part of a game or one or more games provided by a game provider as (i) currency for making wagers, and/or (ii) to purchase or access various in-game items, features or powers. References to an "award", "prize" and/or "payout" herein are intended to encompass such in the form of virtual currency, credits, real currency or any other form of value, tangible or intangible.

A "credit balance", as the term is used herein unless indicated otherwise, refers to (i) a balance of currency, whether virtual currency or real currency, usable for making wagers or purchases in the game (or relevant to the game), and/or (ii) another tracking mechanism for tracking a player's success or advancement in a game by deducting therefrom points or value for unsuccessful attempts at advancement and adding thereto points or value for successful attempts at advancement. A credit balance may be increased or replenished with funds external to the game. For example, a player may transfer funds to the credit balance from a financial account or a gaming establishment may add funds to the credit balance due to a promotion, award or gift to the player.

II. Description of Figures

Example Systems

Referring now to the figures, FIG. 1 depicts a block diagram of an example system 100 according to some embodiments. The system 100 may comprise a plurality of player devices 102*a*-102*n* in communication with a game server 110 via a network 104. For purposes of brevity, any or all of the player devices 102*a*-102*n* will be referred to as a player device 102 herein, even though the plurality of player devices 102*a*-102*n* may include different types of player devices (as described below). The game server 110 may also be operable to communicate with or access a database 140 (which may comprise one or more databases and/or tables and which may comprise a storage device distinct from (or be a component of) the game server 110). It should be noted that in some embodiments database 140 may be stored on a game server 110 while in other embodiments database 140 may be stored on another computing device with which game server 110 is operable to communicate in order to at least access the data in database 140 (e.g., another server device remote from game server 140, operable to determine outcomes for an event instance of a game). In some embodiments a processor (e.g., one or more microprocessors, one or more microcontrollers, one or more digital signal processors) of a player device 102 and/or game server 110 may receive instructions (e.g., from a memory or like device), and execute those instructions, thereby performing one or more processes defined by those instructions. Instructions may be embodied in, e.g., one or more computer programs and/or one or more scripts.

In some embodiments a game server 110 and/or one or more of the player devices 102 stores and/or has access to data useful for facilitating play of a game. For example, game server 110 and/or a player device 102 may store (i) one or more probability databases for determining one or more outcome(s) for an event instance, spin or turn of a game, (ii) a current state or status of a game or game session (e.g., a number of cascades which have occurred for a spin initiated by a player in a reel-type slot machine game), (iii) one or more user interfaces for use in a game, (iv) one or more game themes for a game and/or (v) profiles or other personal information associated with a player of a game. It should be noted that in some embodiments such data may be stored on the game server 110 and information based on such data may be output to a player device 102 during play of a game while in other embodiments a game program may be downloaded to a local memory of a player device 102 and thus such data may be stored on a player device 102 (e.g., in encrypted or other secure or tamper-resistant form).

A game server 110 may comprise a computing device for facilitating play of a game (e.g., by receiving an input from a player, determining an outcome for a game, causing an outcome of a game to be displayed on a player device, determining whether to substitute or output a wild symbol at a particular symbol position of a game interface, facilitating a wager and/or a provision of a payout for a game). For example, the game server 110 may comprise a server computer operated by a game provider or another entity (e.g., a social network website not primarily directed at providing games). In some embodiments, the game server may determine an outcome for spin of a game by requesting and receiving such an outcome from another remote server operable to provide such outcomes. In some embodiments, the game server 110 may further be operable to facilitate a game program for a game (e.g., a wagering game). In accordance with some embodiments, in addition to administering or facilitating play of a game, a game server 110 may comprise one or more computing devices responsible for handling online processes such as, but not limited to: serving a website comprising one or more games to a player device and/or processing transactions (e.g., wagers, deposits into financial accounts, managing accounts, controlling games, etc). In some embodiments, game server 110 may comprise two or more server computers operated by the same entity (e.g., one server being primarily for storing states of games in progress and another server being primarily for storing mechanisms for determining outcomes of games, such as a random number generator). Examples of processes that may be performed by the game server 110 (directly or indirectly)

may include, but are not limited to: (i) determining an initial outcome (i.e., an outcome prior to any replacing or cascading of symbols) for a player; (ii) determining whether the outcome causes a cascade of symbols in the game; (iii) determining whether any of the symbols of the outcome are qualifying symbols and replacing them with appropriate symbols (e.g., different regular symbols, such as symbols cascaded down from a symbol position above the symbol position which comprises the qualifying symbol, or with wild symbols); (iv) determining whether a reel of the game is a qualifying reel; (v) re-evaluating one or more paylines of the game for any additional winning combinations created as a result of any cascading or replacing of symbols; (vi) transmitting an indication of outcomes to a player device; (vii) authorizing a game program to be downloaded to a player device; and/or (viii) modifying (or directing a player device to modify) a game interface which is outputting an outcome of a payline to reflect any cascading and/or substituting of symbols as a result of an initial outcome of the payline.

Turning now to a description of a player device 102, in accordance with some embodiments a player device 102 may comprise a computing device that is operable to execute or facilitate the execution of a game program and used or useful by an online player for accessing an online casino or other electronic (e.g., online) game provider. For example, a player device 102 may comprise a desktop computer, computer workstation, laptop, mobile device, tablet computer, Personal Digital Assistant (PDA) devices, cellular or other wireless telephones (e.g., the Apple™ iPhone™), video game consoles (e.g., Microsoft™ Xbox 360™, Sony™ Playstation™, and/or Nintendo™ Wii™), and/or handheld or portable video game devices (e.g., Nintendo™ Game Boy™ or Nintendo™ DS™). A player device 102 may comprise and/or interface with various components such as input and output devices (each of which is described in detail elsewhere herein) and, in some embodiments, game server 110. A player device 102 may be a dedicated gaming device (e.g., a slot machine) or a non-dedicated gaming device (e.g., an iPad™). It should be noted that a game server 110 may be in communication with a variety of different types of player devices 102.

A player device 102 may be used to play a wagering or non-wagering game (e.g., a social or casual game) over a network and output information relating to the game to players participating in the game (e.g., outcomes for an event instance of the game, qualifying for a bonus round of the game, credit balance of credits available for play of the game, a session result for a session of the game, etc.). Any and all information relevant to any of the aforementioned functions may be stored locally on one or more of the player devices 102 and/or may be accessed using one or more of the player devices 102 (in one embodiments such information being stored on, or provided via, the game server 110). In another embodiment, a player device 102 may store some or all of the program instructions for determining, for example, (i) that an event instance has been triggered or initiated (and, in some embodiments, communicating such a trigger or initiation to game server 110), (ii) a first outcome for a first aspect of the game and a second outcome for a second aspect of the game; (iii) a first result and/or a second result, and/or (iv) determining a session result. In some embodiments, the game server 110 may be operable to authorize the one or more player devices 102 to access such information and/or program instructions remotely via the network 104 and/or download from the game server 110 (e.g., directly or via an intermediary server such as a web server) some or all of the program code for executing one or more of the various functions described in this disclosure. In other embodiments, outcome and result determinations may be carried out by the game server 110 (or another server with which the game server 110 communicates) and the player devices 102 may be terminals for displaying to an associated player such outcomes and results and other graphics and data related to a game.

It should be noted that the one or more player devices 102 may each be located at the same location as at least one other player device 102 (e.g., such as in a casino or internet café) or remote from all other player devices 102. Similarly, any given player device may be located at the same location as the game server 110 or may be remote from the game server 110. It should further be noted that while the game server 110 may be useful or used by any of the player devices 102 to perform certain functions described herein, the game server 110 need not control any of the player devices 102. For example, in one embodiment the game server 110 may comprise a server hosting a website of an online casino accessed by one or more of the player devices 102.

In one embodiment, a game server 110 may not be necessary or desirable. For example, some embodiments described in this disclosure may be practiced on one or more player devices 102 without a central authority. In such an embodiment, any functions described herein as performed by a game server 110 and/or data described as stored on a game server 110 may instead be performed by or stored on one or more player devices 102. Additional ways of distributing information and program instructions among one or more player devices 102, a game server 110 and/or another server device will be readily understood by one skilled in the art upon contemplation of the present disclosure.

Figure 2:
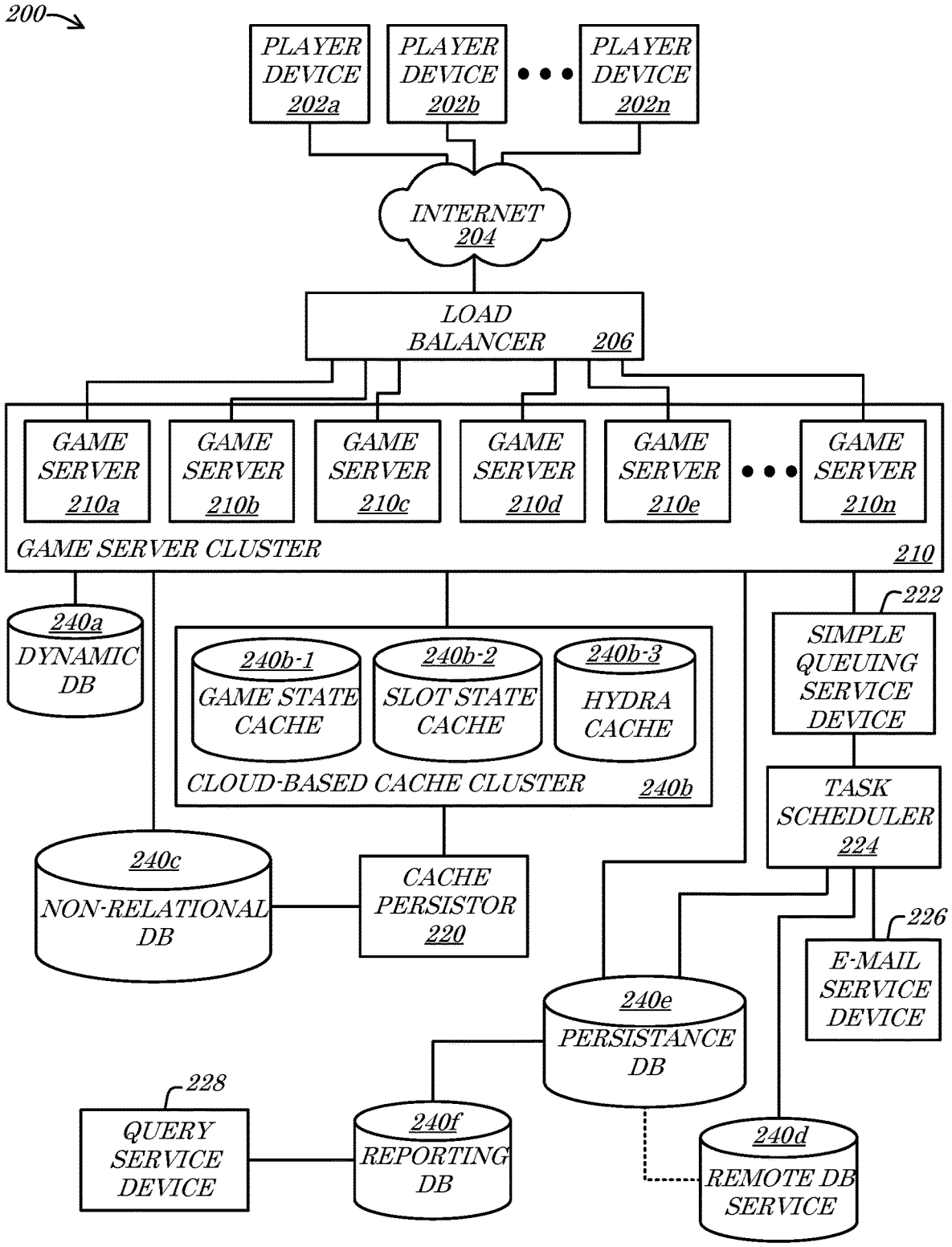
FIG. 2 is a schematic diagram of an embodiment of a social gaming platform in accordance with one or more embodiments described herein.

FIG. 2 a block diagram of an example system 200, which is consistent with some embodiments. In accordance with some embodiments, the system 200 may comprise a plurality of player devices 202*a-n*, the Internet 204, a load balancer 206, and/or a game server cluster 210. The game server cluster 210 may, in some embodiments, comprise a plurality of game servers 210*a-n*. In some embodiments, the system 200 may comprise a cache persistor 220, a Simple Queuing Service (SQS) device 222, a task scheduler 224, an e-mail service device 226, and/or a query service device 228. As depicted in FIG. 2, any or all of the various components 202*a-n*, 204, 206, 210*a-n*, 220, 222, 224, 226, 228 may be in communication with and/or coupled to one or more databases 240*a-f*. The system 200 may comprise, for example, a dynamic DataBase (DB) 240*a*, a cloud-based cache cluster 240*b* (e.g., comprising a game state cache 240*b*-1, a slot state cache 240*b*-2, and/or a "hydra" cache 240*b*-3), a non-relational DB 240*c*, a remote DB service 240*d*, a persistence DB 240*e*, and/or a reporting DB 240*f*.

According to some embodiments, any or all of the components 202*a-n*, 204, 206, 210*a-n*, 220, 222, 224, 226, 228, 240*a-f* of the system 200 may be similar in configuration and/or functionality to any similarly named and/or numbered components described herein. Fewer or more components 202*a-n*, 204, 206, 210*a-n*, 220, 222, 224, 226, 228, 240*a-f* (and/or portions thereof) and/or various configurations of the components 202*a-n*, 204, 206, 210*a-n*, 220, 222, 224, 226, 228, 240*a-f* may be included in the system 200 without deviating from the scope of embodiments described herein. While multiple instances of some components 202*a-n*, 210*a-n*, 240*a-f* are depicted and while single instances of other components 204, 206, 220, 222, 224, 226, 228 are depicted, for example, any component 202*a-n*, 204, 206, 210*a-n*, 220, 222, 224, 226, 228, 240*a-f* depicted in the system 200 may comprise a single device, a combination of devices and/or components 202*a-n*, 204, 206, 210*a-n*, 220, 222, 224, 226, 228, 240*a-f*, and/or a plurality of devices, as is or becomes desirable and/or practicable. Similarly, in some embodiments, one or more of the various components 202*a-n*, 204, 206, 210*a-n*, 220, 222, 224, 226, 228, 240*a-f* may not be needed and/or desired in the system 200.

According to some embodiments, the player device 202*a-n* may be utilized to access (e.g., via the Internet 204 and/or one or more other networks not explicitly shown) content provided by the game server cluster 210. The game server cluster 210 may, for example, provide, manage, host, and/or conduct various online and/or otherwise electronic games such as online bingo, slots, poker, and/or other games of chance, skill, and/or combinations thereof. In some embodiments, the various game servers 210*a-n* (virtual and/or physical) of the game server cluster 210 may be configured to provide, manage, host, and/or conduct individual instances of available game types. A first game server 210*a*, for example, may host a first particular instance of an online bingo game (or tournament), a second game server 210*c* may host a second particular instance of an online bingo game (or tournament), a third game server 210*c* may facilitate an online poker tournament, and/or a fourth game server 210*d* may provide an online slots game.

In some embodiments, the player devices 202*a-n* may comprise various components (hardware, firmware, and/or software; not explicitly shown) that facilitate game play and/or interaction with the game server cluster 210. The player device 202*a-n* may, for example, comprise a gaming client such as a software application programmed in Adobe® Flash® and/or HTML 5 that is configured to send requests to, and receive responses from, one or more of the game servers 210*a-n* of the game server cluster 210. In some embodiments, such an application operating on and/or via the player devices 202*a-n* may be configured in Model-View-Controller (MVC) architecture with a communication manager layer responsible for managing the requests to/responses from the game server cluster 210. In some embodiments, one or more of the game servers 210*a-n* may also or alternatively be configured in a MVC architecture with a communication manager and/or communications management layer. In some embodiments, communications between the player devices 202*a-n* and the game server cluster 210 may be conducted in accordance with the HyperText Transfer Protocol (HTTP) version 1.1 (HTTP/1.1) as published by the Internet Engineering Taskforce (IET) and the World Wide Web Consortium (W3C) in RFC 2616 (June 1999).

According to some embodiments, communications between the player devices 202*a-n* and the game server cluster 210 may be managed and/or facilitated by the load balancer 206. The load balancer 206 may, for example, route communications from player devices 202*a-n* to one or more of the specific game servers 210*a-n* depending upon various attributes and/or variables such as bandwidth availability (e.g., traffic management/volumetric load balancing), server load (e.g., processing load balancing), server functionality (e.g., contextual awareness/availability), and/or player-server history (e.g., session awareness/stickiness). In some embodiments, the load balancer 206 may comprise one or more devices and/or services provided by a third-party (not shown). The load balancer 206 may, for example, comprise an Elastic Load Balancer (ELB) service provided by Amazon® Web Services, LLC of Seattle, Wash. According to some embodiments, such as in the case that the load balancer 206 comprises the ELB or a similar service, the load balancer 206 may manage, set, determine, define, and/or otherwise influence the number of game servers 210*a-n* within the game server cluster 210. In the case that traffic and/or requests from the player devices 202*a-n* only require the first and second game servers 210*a-b*, for example, all other game servers 210*c-n* may be taken off-line, may not be initiated and/or called, and/or may otherwise not be required and/or utilized in the system 200. As demand increases (and/or if performance, security, and/or other issues cause one or more of the first and second game servers 210*a-b* to experience detrimental issues), the load balancer 206 may call and/or bring online one or more of the other game servers 210*c-n* depicted in FIG. 2. In the case that each game server 210*a-n* comprises an instance of an Amazon® Elastic Compute Cloud (EC2) service, the load balancer 206 may add or remove instances as is or becomes practicable and/or desirable.

In some embodiments, the load balancer 206 and/or the Internet 204 may comprise one or more proxy servers and/or devices (not shown in FIG. 2) via which communications between the player devices 202*a-n* and the game server cluster 210 are conducted and/or routed. Such proxy servers and/or devices may comprise one or more regional game hosting centers, for example, which may be geographically dispersed and addressable by player devices 202*a-n* in a given geographic proximity. In some embodiments, the proxy servers and/or devices may be located in one or more geographic areas and/or jurisdictions while the game server cluster 210 (and/or certain game servers 210*a-n* and/or groups of game servers 210*a-n* thereof) is located in a separate and/or remote geographic area and/or jurisdiction.

According to some embodiments, for some game types the game server cluster 210 may provide game outcomes to a controller device (not separately shown in FIG. 2) that times the release of game outcome information to the player devices 202*a-n* such as by utilizing a broadcaster device (also not separately shown in FIG. 2) that transmits the time-released game outcomes to the player devices 202*a-n* (e.g., in accordance with the Transmission Control Protocol (TCP) and Internet Protocol (IP) suite of communications protocols (TCP/IP), version 4, as defined by "Transmission Control Protocol" RFC 793 and/or "Internet Protocol" RFC 791, Defense Advance Research Projects Agency (DARPA), published by the Information Sciences Institute, University of Southern California, J. Postel, ed. (September 1981)).

In some embodiments, the game server cluster 210 (and/or one or more of the game servers 210*a-n* thereof) may be in communication with the dynamic DB 240*a*. According to some embodiments, the dynamic DB 240*a* may comprise a dynamically-scalable database service such as the DynamoDB™ service provided by Amazon® Web Services, LLC. The dynamic DB 240*a* may, for example, store information specific to one or more certain game types (e.g., a reeled slots themed game) provided by the game server cluster 210 such as to allow, permit, and/or facilitate reporting and/or analysis of such information.

According to some embodiments, the game server cluster 210 (and/or one or more of the game servers 210*a-n* thereof) may be in communication with the cloud-based cache cluster 240*b*. Game state information from the game server cluster 210 may be stored in the game state cache 240*b*-1, for example, slot state (e.g., slot-game specific state) data may be stored in the slot state cache 240*b*-2, and/or other game and/or player information (e.g., progressive data, player rankings, audit data) may be stored in the hydra cache 240*b*-3. In some embodiments, the cache persistor 220 may move and/or copy data stored in the cloud-based cache cluster 240*b* to the non-relational DB 240*c*. The non-relational DB 240*c* may, for example, comprise a SimpleDB™ service provided by Amazon® Wed Services, LLC. According to some embodiments, the game server cluster 210 may generally access the cloud-based cache cluster 240*b* as-needed to store and/or retrieve game-related information. The data stored in the cloud-based cache cluster 240*b* may generally comprise a subset of the newest or freshest data, while the cache persistor 220 may archive and/or store or move such data to the non-relational DB 240*c* as it ages and/or becomes less relevant (e.g., once a player logs-off, once a game session and/or tournament ends). The game server cluster 210 may, in accordance with some embodiments, have access to the non-relational DB 240*c* as-needed and/or desired. The game servers 210*a-n* may, for example, be initialized with data from the non-relational DB 240*c* and/or may store and/or retrieve low frequency and/or low priority data via the non-relational DB 240*c*.

In some embodiments, the SQS device 222 may queue and/or otherwise manage requests, messages, events, and/or other tasks or calls to and/or from the server cluster 210. The SQS device 222 may, for example, prioritize and/or route requests between the game server cluster 210 and the task scheduler 224. In some embodiments, the SQS device 222 may provide mini-game and/or tournament information to the server cluster 210. According to some embodiments, the task scheduler 224 may initiate communications with the SQS device 222, the e-mail service provider 226 (e.g., providing e-mail lists), the remote DB service 240*d* (e.g., providing inserts and/or updates), and/or the persistence DB 240*e* (e.g., providing and/or updating game, player, and/or other reporting data), e.g., in accordance with one or more schedules.

According to some embodiments, the persistence DB 240*e* may comprise a data store of live environment game and/or player data. The game server cluster 210 and/or the task scheduler 224 or SQS device 222 may, for example, store game and/or player data to the persistence DB 240*e* and/or may pull and/or retrieve data from the persistence DB 240*e*, as-needed and/or desired. The server cluster 210 may, according to some embodiments, provide and/or retrieve spin and/or other game event info and/or configuration information via the persistence DB 240*e*.

In some embodiments, the reporting DB 240*f* may be created and/or populated based on the persistence DB 240*e*. On a scheduled and/or other basis, for example, a data transformation and/or mapping program may be utilized to pull data from the live environment (e.g., the persistence DB 240*e*) into the reporting DB 240*f*. The query service 228 may then be utilized, for example, to query the reporting DB 240*f*, without taxing the live environment and/or production system directly accessible by the game server cluster 210.

Figure 3:
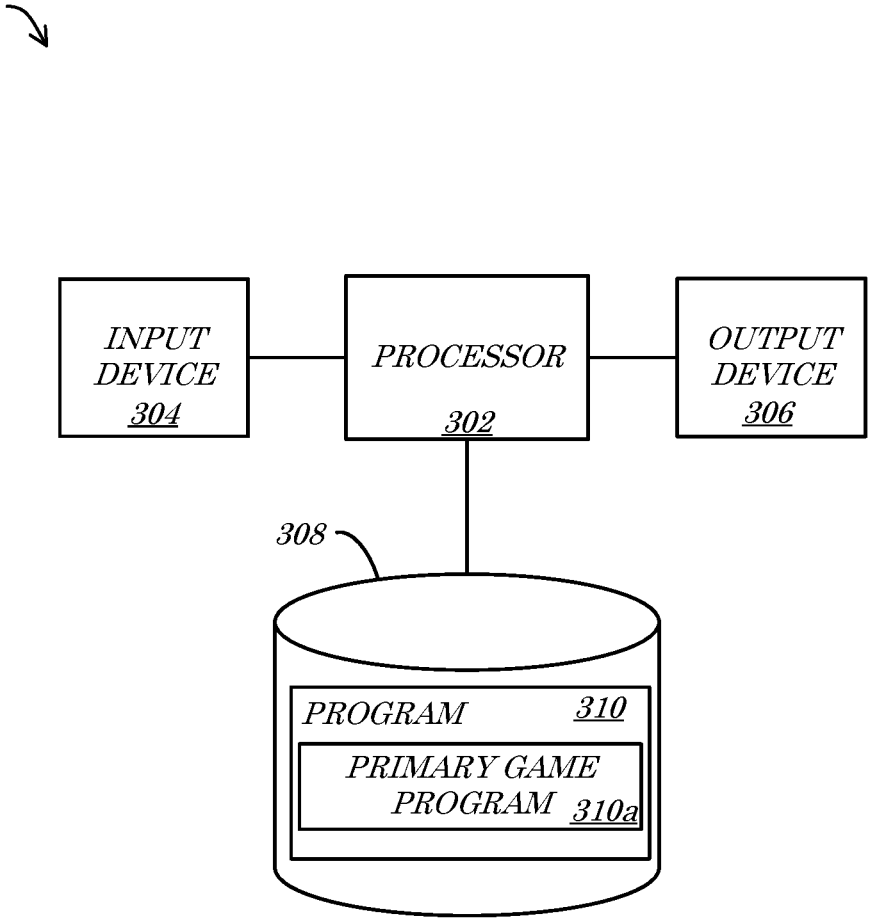
FIG. 3 is a block diagram of an embodiment of a computing device useful in a system according to one or more embodiments described herein.

FIG. 3 is a block diagram of an apparatus 300 according to some embodiments. In some embodiments, the apparatus 300 may be similar in configuration and/or functionality to any of the player devices 102, the game server 110 and/or another server device operable to facilitate the embodiments described herein. The apparatus 300 may, for example, execute, process, facilitate, and/or otherwise be associated with any of the processes 700 and/or 800 described herein in conjunction with FIG. 7 and FIG. 8, respectively.

In some embodiments, the apparatus 300 may comprise a processor 302, an input device 304, an output device 306 and/or a memory device 308. Fewer or more components and/or various configurations of the components 302, 304, 306 and/or 308 may be included in the apparatus 300 without deviating from the scope of embodiments described herein.

According to some embodiments, the processor 302 may be or include any type, quantity, and/or configuration of processor that is or becomes known. The processor 302 may comprise, for example, an Intel® IXP 2800 network processor or an Intel® XEON™ Processor coupled with an Intel® E7501 chipset. In some embodiments, the processor 302 may comprise multiple inter-connected processors, microprocessors, and/or micro-engines. According to some embodiments, the processor 302 (and/or the apparatus 300 and/or other components thereof) may be supplied power via a power supply (not shown) such as a battery, an Alternating Current (AC) source, a Direct Current (DC) source, an AC/DC adapter, solar cells, and/or an inertial generator. In the case that the apparatus 302 comprises a server such as a blade server, necessary power may be supplied via a standard AC outlet, power strip, surge protector, and/or Uninterruptible Power Supply (UPS) device.

In some embodiments, the input device 304 and/or the output device 306 are communicatively coupled to the processor 302 (e.g., via wired and/or wireless connections and/or pathways) and they may generally comprise any types or configurations of input and output components and/or devices that are or become known, respectively.

The input device 304 may comprise, for example, a keyboard that allows an operator of the apparatus 300 to interface with the apparatus 200 (e.g., by a player, an employee or other worker affiliated with either an online casino or other entity operating a system which provides games to players). In some embodiments, the input device 304 may comprise a mechanism configured to indicate to a remote server device an initiation or triggering of an event instance (e.g., that a player has actuated a "reel spin" mechanism and thus initiated a new spin of a reels-based game), such information being provided to the apparatus 300 and/or the processor 302. In such embodiments, the input device may comprise a key on a keyboard of the apparatus 300. Other examples of input devices include, but are not limited to: a game controller and/or gamepad, a bar-code scanner, a magnetic stripe reader, a pointing device (e.g., a computer mouse, touchpad, and/or trackball), a point-of-sale terminal keypad, a touch-screen, a microphone, an infrared sensor, a sonic ranger, a computer port, a video camera, a motion detector, a digital camera, a network card, a Universal Serial Bus (USB) port, a GPS receiver, a Radio Frequency Identification (RFID) receiver, a RF receiver, a thermometer, a pressure sensor, and a weight scale or mass balance.

The output device 306 may, according to some embodiments, comprise a display screen and/or other practicable output component and/or device that is operable to output information. The output device 306 may, for example, comprise a display screen via which are output outcomes, instructions, guidance, questions or information to a player of a game. For example, the output device may output a game interface for a bonus round which indicates an outcome of an event instance of the bonus round, such as the symbols populated into respective ones of a plurality of symbol positions comprising the game interface position, an indication that a reel has been determined to be a qualifying reel and/or any payouts or other awards won or earned by a player as a result of an outcome of the game. Some additional examples of output devices that may be useful in some embodiments include a Cathode Ray Tube (CRT) monitor, a Liquid Crystal Display (LCD) screen, a Light Emitting Diode (LED) screen, a printer, an audio speaker, an Infra-red Radiation (IR) transmitter, an RF transmitter, and/or a data port. According to some embodiments, the input device 304 and/or the output device 306 may comprise and/or be embodied in a single device such as a touch-screen display or screen.

In some embodiments, the apparatus 300 may comprise any type or configuration of communication device (not shown) that is or becomes known or practicable. For example, the apparatus 300 may include a communication device such as a NIC, a telephonic device, a cellular network device, a router, a hub, a modem, and/or a communications port or cable. In some embodiments, the communication device may be coupled to provide data to a telecommunications device. The communication device may, for example, comprise a cellular telephone network transmission device that sends signals (e.g., an initiation of an event instance) to a server (e.g., game server 110) in communication with a plurality of player devices 102. According to some embodiments, the communication device may also or alternatively be coupled to the processor 302. In some embodiments, the communication device may comprise an IR, RF, Bluetooth™, and/or Wi-Fi® network device coupled to facilitate communications between the processor 202 and another device.

The memory device 308 may comprise any appropriate information storage device that is or becomes known or available, including, but not limited to, units and/or combinations of magnetic storage devices (e.g., a hard disk drive), optical storage devices, and/or semiconductor memory devices such as Random Access Memory (RAM) devices, Read Only Memory (ROM) devices, Single Data Rate Random Access Memory (SDR-RAM), Double Data Rate Random Access Memory (DDR-RAM), and/or Programmable Read Only Memory (PROM).

The memory device 308 may, according to some embodiments, store a program 310 for facilitating one or more of the embodiments described herein, which program may include a primary game program 310*a* for facilitating a primary aspect of a game (in some embodiments the program 310 may further include a bonus round program for facilitating a bonus round of the game, not shown). In some embodiments, the primary game program 310*a* and/or the bonus round program 310*b* (not shown) may be utilized by the processor 302 to provide output information via the output device 306.

The primary game program 310*a* may, for example, provide instructions for determining at least one of: (i) an outcome for the primary game responsive to a wager or other input from a player which initiates an event instance of the game (e.g., by requesting a random number from another server or device), (ii) which symbol positions (e.g., reel positions) should be populated with which symbols; (iii) determining, for each payline (or each active payline, depending on the embodiment being implemented) whether the outcome of the payline includes a winning combination and, if so, the payout or other award to provide to the player; (iv) increasing the credit balance of the player based on any payouts won as a result of the outcome; (v) whether any reel is a qualifying reel; (vi) replacing all the symbols on each qualifying reel with at least one wild symbol; and/or (iv) re-evaluating each payline to determine whether the player has won any additional payouts as a result of the qualifying reel symbols being replaced with the at least one wild symbol. In some embodiments in which a cascade feature is utilized, the primary game program 310*a* may further include instructions for implementing a cascade if an outcome of the event instance qualifies for a cascade (e.g., removed all the qualifying symbols of each winning combination and replacing them with the symbols above from the symbol matrix).

The apparatus 300 may function as a computer terminal and/or server of an online casino or other entity operating to provide online games, receive and/or manage information related to online games. In some embodiments, the apparatus 300 may comprise a web server and/or other server device operable to accept wagers and determine random numbers based upon which outcomes for wagering games are determined. In some embodiments, the apparatus 300 may comprise an apparatus that is operable to interact with a player of an online game. In some embodiments, apparatus 300 may comprise a plurality of devices working together to accomplish the functionality described herein with respect to FIG. 3.

Any or all of the exemplary instructions and data types described herein and other practicable types of data may be stored in any number, type, and/or configuration of memory devices that is or becomes known. The memory device 308 may, for example, comprise one or more data tables or files, databases, table spaces, registers, and/or other storage structures. In some embodiments, multiple databases and/or storage structures (and/or multiple memory devices 308) may be utilized to store information associated with the apparatus 300. According to some embodiments, the memory device 308 may be incorporated into and/or otherwise coupled to the apparatus 300 (e.g., as shown) or may simply be accessible to the apparatus 200 (e.g., externally located and/or situated).

Example Interfaces

Figure 4:
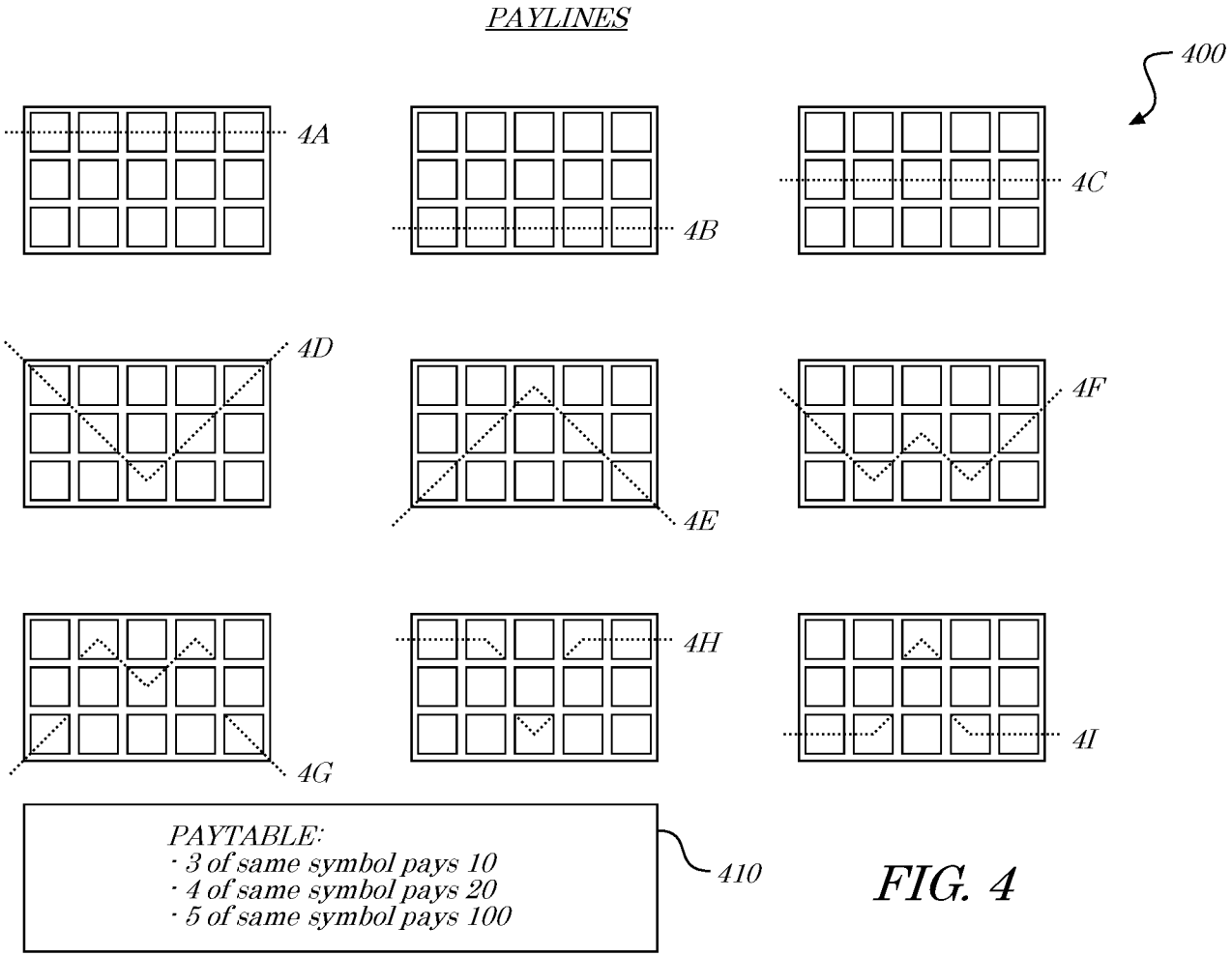
FIG. 4 is an illustration of one example embodiment of a game interface which may be used to output an indication of at least one payline and payouts available in a game.

Turning now to FIG. 4, illustrated therein is an example game interfaces which embodies some embodiments described herein. In particular, FIG. 4 is a representation of the different paylines available in a game and the payout schedule for the game (e.g., winning combinations and the corresponding payout amounts). For example, a screen comprising the information of FIG. 4 (or similar information) may be output to a player who requests to see the paylines and payout schedule for the game. The paylines and payout schedule illustrated in FIG. 4 are utilized in the example embodiment illustrated via FIGS. 5A through 5F and will be referred to herein in the description of a progression of the game depicted in FIGS. 5A through 5F. As illustrated in FIG. 4, there are nine (9) paylines in the game, referred to as paylines 4A, 4B, 4C, 4D, 4E, 4F, 4G, 4H and 4I. The particular symbol positions of a symbol matrix which make up each respective payline are depicted as having a dotted line passing through them.

The game represented in the game interface of FIG. 4 (as well as the game interfaces of FIGS. 5A through 5F, FIGS. 6A through 6B and FIGS. 9A through 9B) consists of five vertical reels, with each reel having three symbol positions visible to a player of the game. Thus, the game used in FIGS. 4, 5A-5F, 6A through 6B and 9A-9B may be thought of as having a 3×5 symbol matrix (3 rows and 5 columns (reels)). In accordance with one embodiment, there are nine (9) possible paylines along which a winning combination of symbols may result in a payout or other prize being awarded to a player. Of course any number of reels, number of symbol positions on each reel or paylines may be utilized and the embodiments described herein are not dependent on any particular number or configuration of reels, symbol positions in a symbol matrix or number or configuration of paylines.

Although a reel-based slot machine-type game is used here to illustrate some embodiments, the embodiments are not limited to such an implementation. Many of the embodiments described herein may be applied to any game interface which includes symbols placed into symbol positions and a determination of whether a player qualifies for a prize based on whether the symbols located in a predetermined set or pattern of the symbol positions include a winning combination of symbols. For example, in a multi-hand card game in which a plurality of hands (e.g., a hand being a set of five cards) are arranged in rows of a symbol matrix, one embodiment may comprise replacing each card in a particular card position (e.g., each first card of each hand, each second card of each hand, etc.) with a wild card (or other special card) if a predetermined condition is satisfied (e.g., the total payout for the hands is at least X, at least a predetermined number (or all) of the hands qualify for a payout prior to the replacement. Other examples of different types of games to which the wild game mechanic described herein may be applied include, without limitation, bingo and keno.

For purposes of describing some embodiments, in the reel game interface of FIG. 4, FIGS. 5A through 5F, FIGS. 6A through 6B and FIGS. 9A through 9B, the top visible symbol position of a given reel is referred to as position "0" herein, the middle visible symbol position of a given reel is referred to as position "1" herein and the bottom visible symbol position is referred to as position "2" herein. Thus, for example, payline 4A in FIG. 4 consists of position "0" on each of the five reels; payline 4B consists of position "2" on each of the five reels and payline 4C consists of position "1" on each of the five reels.

The example game depicted in FIGS. 4, 5A through 5F, 6A through 6B and 9A through 9B is an "A-B-C-D" themed game in which the regular symbols are "A", "B", "C" and "D" and a wild symbol ("W") may take the place of (or be counted as, for purposes of determining a winning combination of symbols) any of the regular symbols. Area 410 of FIG. 4 indicates which combinations of symbols are considered winning combinations and the corresponding payout for each winning combination. For purposes of brevity, only a simplistic model of winning combinations is illustrated: (i) three (3) of the same regular symbol (or a combination of the same regular symbol and one or more wild symbols)) along a given payline will result in a payout or award of ten (10) credits being provided to the player (e.g., added to a credit meter balance associated with the player; (ii) four (4) of the same regular symbol (or a combination of the same regular symbol and one or more wild symbols) along a given payline will result in a payout of twenty (20) credits being provided to the player; and (iii) five (5) of the same regular symbol (or a combination of the same regular symbol and one or more wild symbols) will result in a payout of one-hundred (100) credits being provided to the player. The payline configurations 4A through 4I and payout table 410 will be referred to in the descriptions of FIGS. 5A through 5F, FIGS. 6A through 6B and FIGS. 9A through 9B.

Figure 5A:
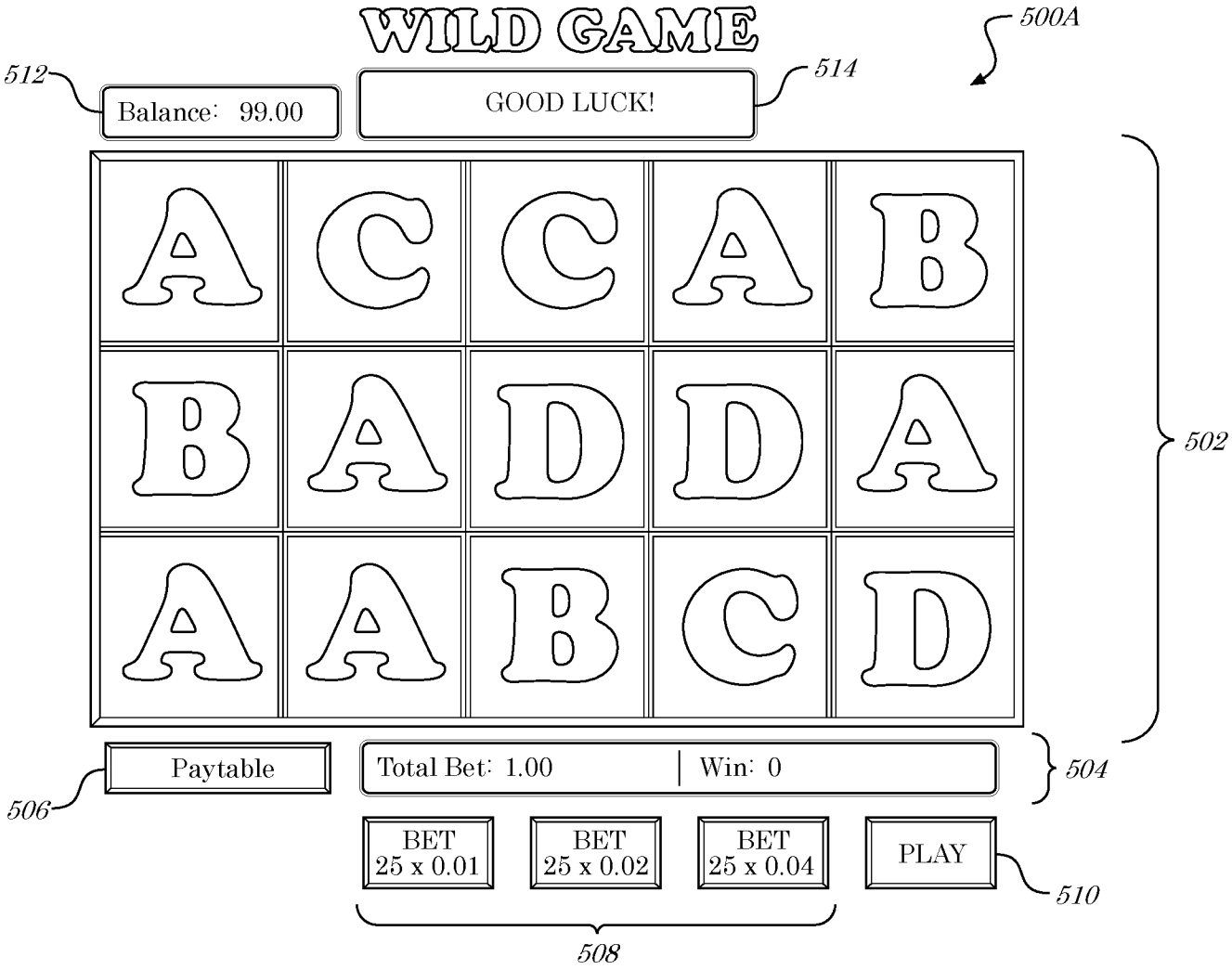
FIGS. 5A through 5F together illustrate one example embodiment of a game interface (e.g., a screen shot of an online game) for facilitating a game, as it is modified over the course of multiple events in the game, in a manner consistent with one or more embodiments described herein.

Turning now to FIG. 5A, illustrated therein is an example of a game interface 500A as it may be output to a player who is initiating a game session or about to initiate a new game event (e.g., a new spin) for the game. In particular, FIG. 5A is an illustration of a screen shot which shows a "snapshot in time" of a current status of a game event (e.g., the bet placed, the symbols comprising the outcome, any payout won as a result of the outcome), such as it may appear to a player once the reels of the game interface stop spinning and the game event comprising the spin is resolved. For purposes of illustrating some embodiments, the game shown as progressing in FIGS. 5A through 5F is one in which the predetermined condition for a reel being determined to be a qualifying reel is that each symbol on the reel, upon a resolution of a game event (e.g., a spin of the reels) is a qualifying symbol in the sense that each symbol on the reel is part of a winning combination of symbols along a payline of the game. It may further be assumed, for purposes of the present example, that a maximum bet of 1.00 causes each of the available nine (9) paylines to be active (i.e., to be evaluated for the presence of a winning combination of symbols and for a corresponding payout to be awarded to the player if such a winning combination is found).

The game interface 500A includes a plurality of areas for outputting information to a player. The areas include area 502, which is the symbol matrix comprising a plurality of symbol positions arranged in a configuration of five (5) columns (e.g., reels) and three (3) rows. Each intersection of a row and column comprises a unique symbol position (e.g., reel position "0" of the first reel on the left is a symbol position which in FIG. 5A has the symbol "A" placed therein while reel symbol position "1" of the first reel on the left is a symbol position which in FIG. 5A has the symbol "B" placed therein). Area 504 of the screen interface outputs to the player (i) the total bet or wager being placed on the current game event; and (ii) the total win or payout won by the player as a result of the game event. In the example of FIG. 5A, it is shown that a total bet of 1.00 (e.g., credits, dollars or another currency) has been placed on the current game event and that the player has not won anything as a result of the game event. A comparison to the paylines being utilized in the current game, illustrated in FIG. 4, shows that none of the paylines comprise three (3) or more of the same regular symbol as a result of the game event. Area 506 of the game interface 500A, if actuated or selected by the player, will cause a paytable and/or other information explaining the rules or mechanics of the game to be displayed to the player (e.g., via a new screen or pop-up window). For example, a selection of area 506 by a player may cause a screen similar to that depicted in FIG. 4 to be output to the player, informing the player of the paylines and payout schedule of the game.

It should be noted that the symbols to be output in the area 502 for a game event may be determined based on a pseudo-random process. For example, an RNG may be used to determine a random number which may then be used to determine the symbols to output in area 502. The RNG may be stored in, for example, a game server (e.g., game server 110 of FIG. 1), another server device in communication with a player device on which the game is being played or the player device itself. In some embodiments, the initiation of an event instance (e.g., a game event such as an initiation of a spin) or other request for an outcome of the game may cause the player device to request the outcome (or an RNG based upon which an outcome may be determined) from another device such as a game server (e.g., game server 110 of FIG. 1). Thus, in some embodiments when a player places a wager and initiates a game event (e.g., by actuating or selecting the "play" button or area 510, this may cause an outcome for the game event to be determined (e.g., which symbol should be placed in each symbol position of the game matrix) by at least one of the player device and a remote server device, based on an RNG process or another process.

Area 508 includes a selection of different bet amounts which a player may select for a given game event. For example, he player may choose to bet 0.25 (i.e., 25×0.01), 0.50 (i.e., 25×0.02), or 1.00 (i.e., 25×0.04). Of course, additional or different bet amounts may be used and the embodiments described herein are not limited to any particular bet amount or number of bet amounts.

Area 512 indicates to the player the current amount of the player's credit balance. In the current example, the player has 99.00 credits available for wagering from the credit balance. A bet the player places may be deduced from the credit balance shown in area 512 and any payouts won by the player may be added to the credit balance shown in area 512. Area 514 is an area for dynamically outputting messages to the player (e.g., messages of encouragement, status information and/or an explanation of a game event).

In the present application, like reference numerals in the Figures refer to like elements. Thus, for example, in the FIGS. 5A through 5F (which show a progression of game over the course of an initial spin and subsequent game events), area 502 is repeated (although it may be shown to output different symbols in the symbol positions of the game matrix, based on an outcome of a spin or replacement of symbols). Similarly, areas 504, 506, 608, 510 and 512 are also repeated, although the information or data shown in them may change (e.g., the credit balance shown in area 512 is adjusted based on game events).

It should be noted that additional information may be output to the player via the interface illustrated in FIGS. 5A through 5F, which additional information is omitted herein for purposes of brevity. For example, player history or preferences, information about other games the player is participating in, recommendations or tips for betting, etc. may be show for one or more players.

Figure 5B:
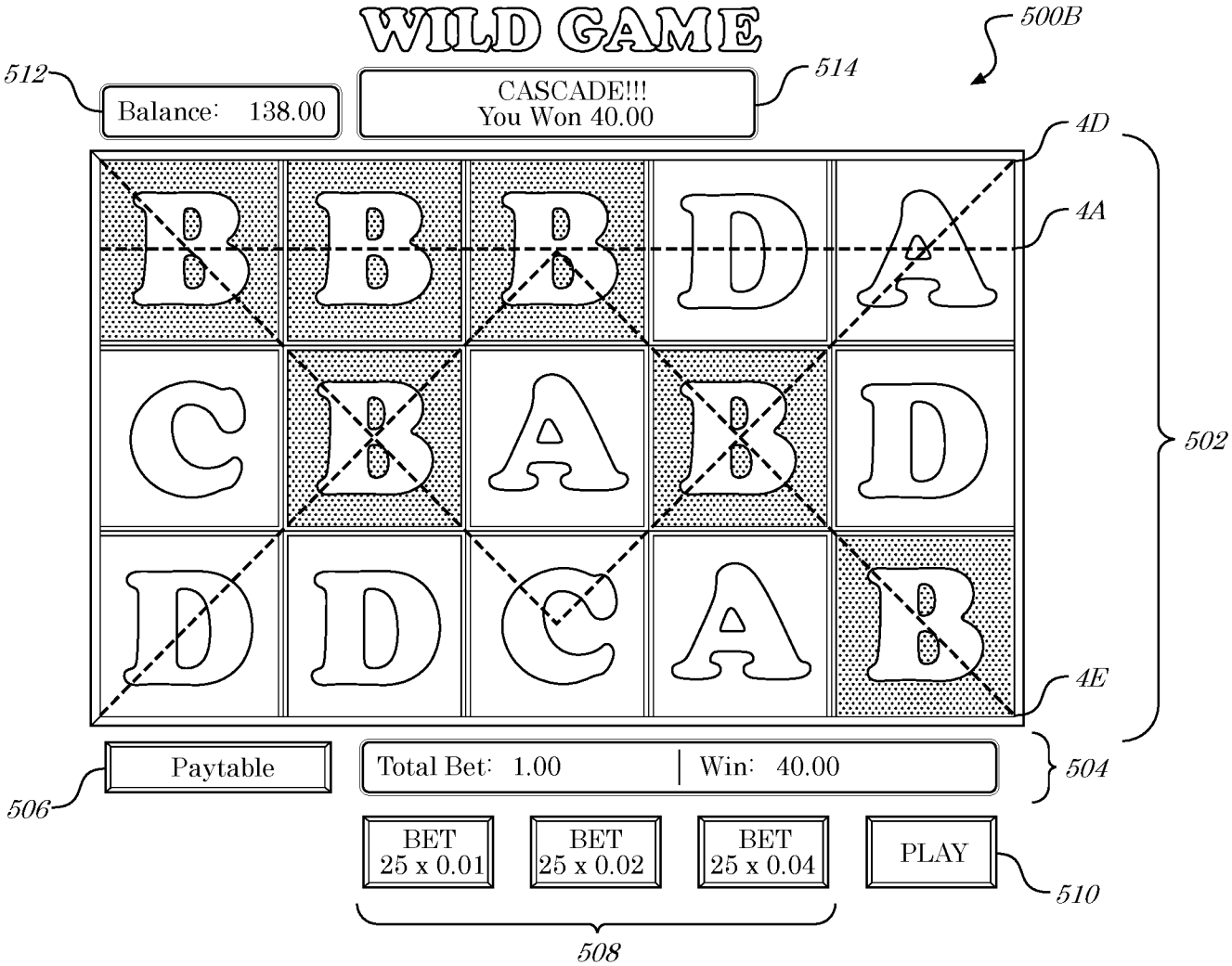

Turning now to FIG. 5B, screen shot 500B (which shows the progress in the game of a player since that shown in FIG. 5A) illustrates that the player has placed another 1.00 bet (as indicated in area 504) and has won, as a result of the game event for which the bet was placed (the spin of the reels in this example) a total payout of 40.00. The credit meter balance in area 512 illustrates the change in credit balance (from the 99.00 shown in FIG. 5A) as a result of the 1.00 bet being deducted and the 40.00 win being added, bringing the credit meter balance to 138.00. The 40.00 total win for the game event comprising the spin initiated by the player's bet is derived as follows (with reference to the paylines and payout table of FIG. 4): (i) 10.00 was won based on the presence of three (3) "B" symbols along payline 4A; (ii) 20.00 was won based on the presence of four (4) "B" symbols along payline 4E; and (iii) 10.00 was won based on the presence of three (3) "B" symbols along payline 4D. An evaluation of the regular symbols and paylines output in the symbol matrix comprising the reels reveals that none of the reels are qualifying reels because none of the reels are comprised of symbols which are each part of a respective winning combination of symbols along a payline.

Figure 5C:
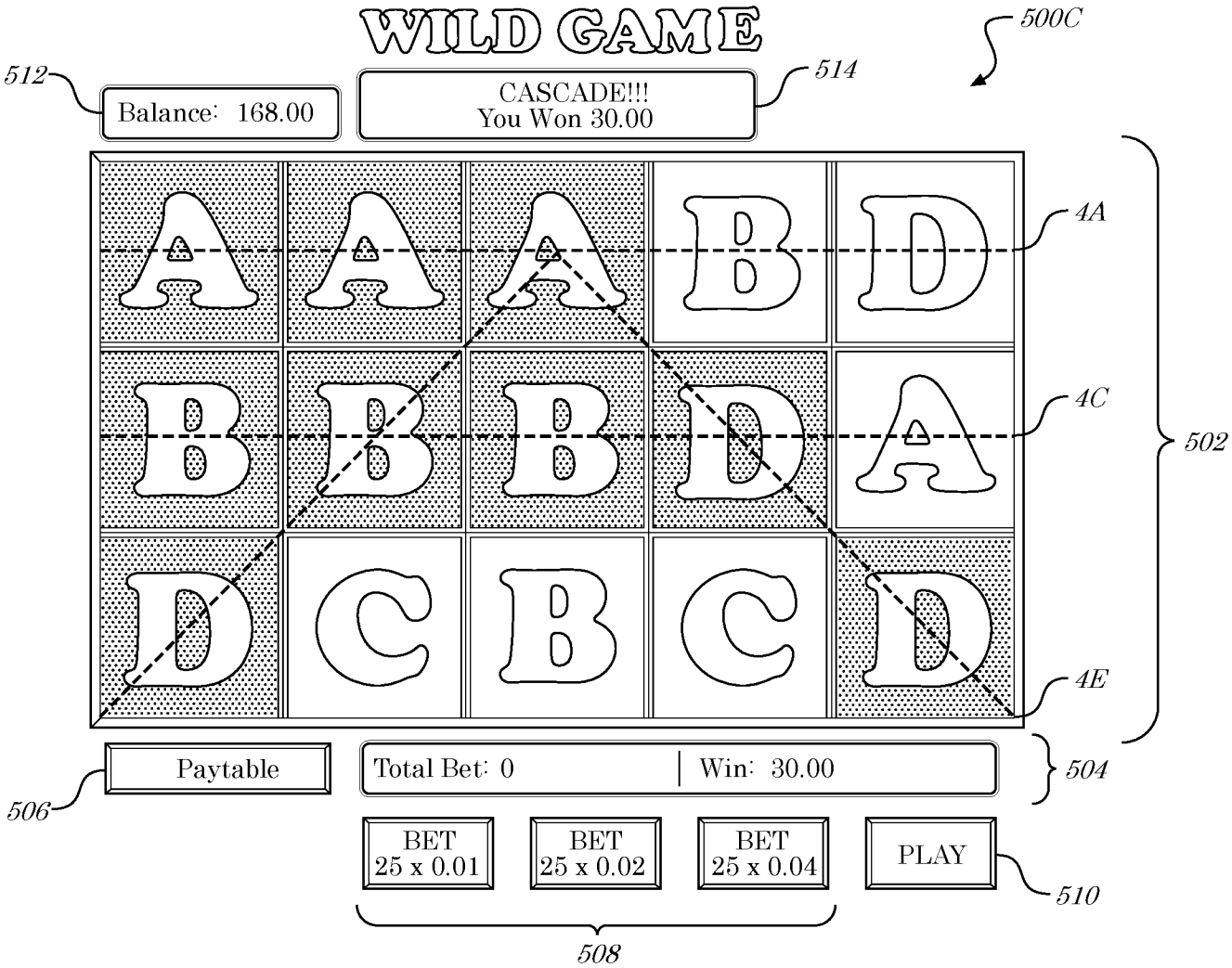

Area 514 informs the player that not only has (s)he won 40.00 as a result of the spin, a cascade of the reels has also been triggered. In accordance with some embodiments, each qualifying symbol (e.g., each symbol which is part of a winning combination of symbols along a payline) is removed from the symbol matrix after the payout for the spin has been provided, and the symbol from the symbol position immediately above is moved down to the symbol position of the removed symbol. FIG. 5C illustrates an implementation of such a cascade feature as applied to the outcome depicted in FIG. 5B.

Turning now to FIG. 5C, screen shot 500C (which shows the progress in the game of the player since that shown in FIG. 5B) illustrates that the "B" symbols (which were each part of a winning combination of symbols as illustrated in FIG. 5B) have been replaced as a result of the cascade: (i) position "0" of each of the first three reels; (ii) position "1" of the second and fourth reel; and (iii) position "2" of the fifth reel. It should be noted that each of these symbols were highlighted in FIG. 5B by means of darker shading in the background of each of these symbol positions. While a change in the background of the symbol position of a qualifying symbol is not a requirement of any embodiment, the highlighting is utilized in FIGS. 5A through 5F (as well as in FIGS. 6A and 6B) to help identify the qualifying symbols for the reader. The symbols which were removed and replaced (the six (6) "B" symbols) were replaced by the symbol located immediately above them in the symbol matrix, if there was a symbol above the symbol in the visible symbol matrix. Thus, for example, the "B" symbol removed from position "1" of the fourth reel was replaced by the "D" symbol which dropped down from the "0" position of the same reel and the "B" symbol removed from position "2" of the fifth reel was replaced by the "D" symbol which dropped down from the "1" position of the same reel.

The "B" symbols which were removed but which did not have another symbol visible above them in the symbol matrix (e.g., the "B" symbols in the "0" position of the first three reels) may be replaced in a variety of manners. For example, in one embodiment a replacement symbol may be randomly generated. In another example, there may be a symbol which had previously been determined as being located above the symbols being removed from the "0" positions of the reels but such symbols may not have been visible to the player (i.e., may be on the reel but on a portion of the reel that is not part of the visible reel matrix) or had otherwise been previously determined as available for replacing symbols in such symbol positions. The particular manner in which another regular symbol is determined for replacing a qualifying symbol which is being removed is not important to the embodiments described herein.

As further illustrated in area 504 of FIG. 5C, a wager has not been deducted from the credit balance for the cascade feature being effectuated in FIG. 5C. In accordance with one embodiment, a cascade feature is a free bonus awarded to a player. In other embodiments, a wager may be deducted for a cascade (in such latter embodiments a player may be provided with an option to accept or reject the cascade and thus agree to the wager).

As a result of the cascade feature applied in FIG. 5C, the player has won a total of 30.00 credits, which has been added to the player's credit balance. Thus, the credit balance (shown in area 512) has been increased from 138.00 (as of the game event illustrated in FIG. 5B) to 168.00. The 30.00 total win for the game event comprising the reel cascade triggered by the presence of winning combinations as a result of the spin in FIG. 5C is derived as follows (with reference to the paylines and payout table of FIG. 4): (i) 10.00 was won based on the presence of three "A" symbols along payline 4A; (ii) 10.00 was won based on the presence of three "B" symbols along payline 4C; and (iii) 10.00 was won based on the presence of three "D" symbols along payline 4E.

Figure 5D:
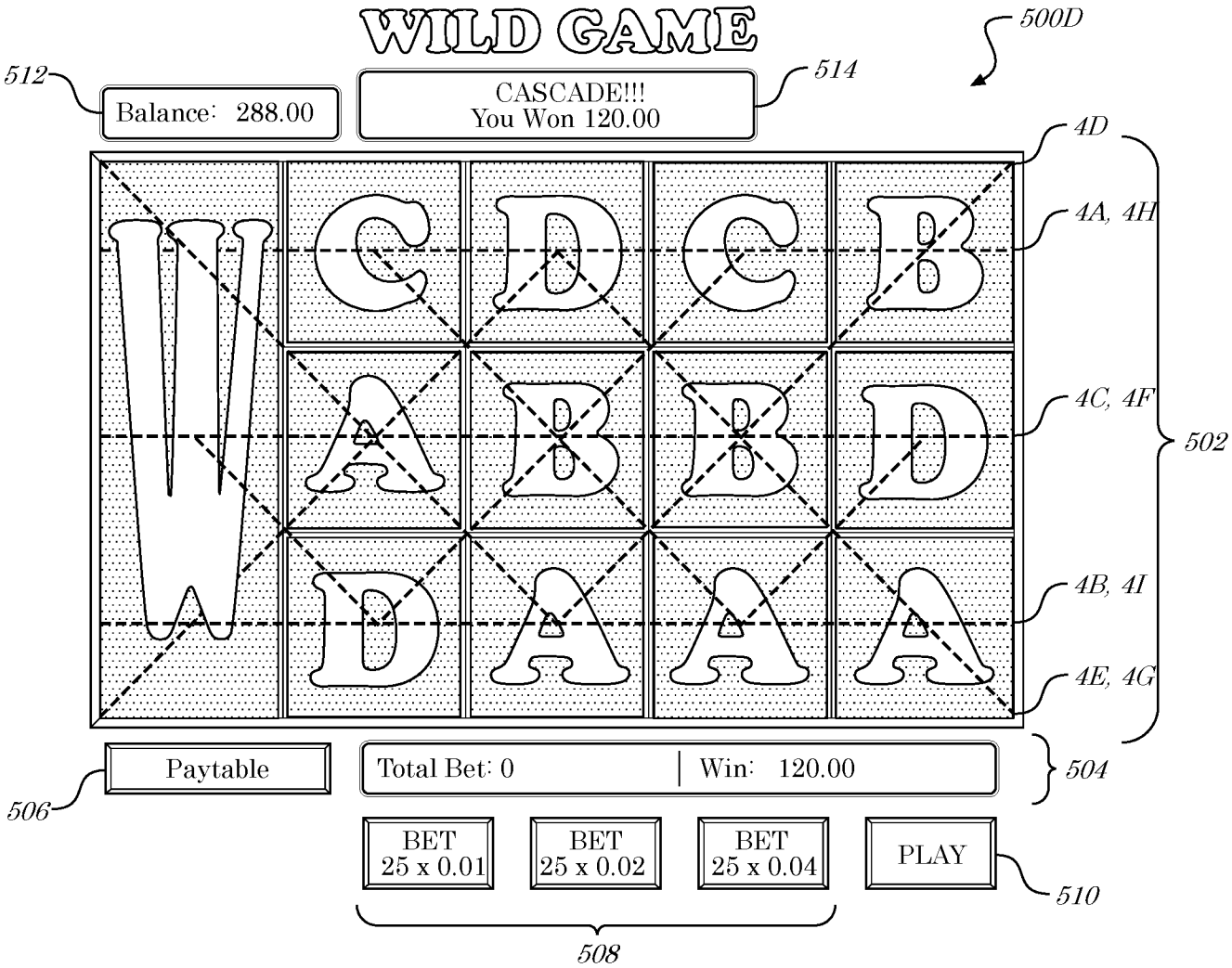

In accordance with some embodiments, the cascade feature is an on-going game mechanic such that if additional winning combinations are created as a result of a cascade, another cascade is triggered. The game illustrated in FIGS. 5A through 5F employs such an on-going cascade mechanic. Thus, because additional winning combinations were created as a result of the cascade outcome illustrated in FIG. 5C (along paylines 4A, 4C and 4E), a second cascade is triggered. The game illustrated in FIGS. 5A through 5F also employs the wild reel feature described herein. As described herein, in accordance with one embodiment of the wild reel feature, if each symbol in each respective symbol position of a given reel is part of a winning combination of symbols (e.g., whether as a result of a cascade or as a result of an original spin initiated by the player), each of the symbols on that reel will be replaced by at least one wild symbol. The first reel in FIG. 5C has a symbol in each of the positions that is part of a winning combination of symbols: (i) the "A" symbol in position "0" is part of the winning combination of three (3) "A" symbols along payline 4A; (ii) the "B" symbol in position "1" is part of the winning combination of three (3) "B" symbols along payline 4C; and (iii) the "D" symbol in position "2" is part of the winning combination of three (3) "D" symbols along payline 4E. Thus, in accordance with one embodiment the first reel satisfies the predetermined condition for being a qualifying reel and is thus turned into a "wild reel" (e.g., a reel which comprises all wild symbols or a wild symbol which applies to all symbol positions). FIG. 5D illustrates one example implementation of the wild reel feature.

Turning now to FIG. 5D, screen shot 500D (which shows the progress in the game of the player since that shown in FIG. 5C, once the wild reel and cascade game mechanics were effectuated) illustrates the outcome which resulted from (i) the replacement of all the symbols on the first reel with a "W" wild symbol (which is equivalent to any regular symbol of the game) and which may be counted as any regular symbol in any of the positions of the reel; and (ii) the cascade which replaced all other qualifying symbols (as indicated in area 502 of FIG. 5C by virtue of the shaded backgrounds in each symbol position including a qualifying symbol). It should be noted that in an alternate embodiment three distinct wild symbols (e.g., three (3) "W"s) may be used. But in some embodiments the visual representation of a single symbol which is displayed as taking up the whole reel such that individual positions of the reel are no longer visible or discernable to the player may be appealing or desirable. For example, it may allow for more flexibility in terms of the size, type, creativity or visual appeal of the symbol utilized to depict a qualifying or "wild" reel or other type of symbol matrix portion (e.g., a row of a bingo or keno symbol matrix).

As indicated in area 504 and in area 514, the total payout won as a result of the wild reel implementation and the cascade is 120.00. The credit meter balance (shown in area 512) is thus now 288.00. The 120.00 total win for the game event comprising the wild reel and the reel cascade triggered by the presence of winning combinations as a result of the spin in FIG. 5D is derived as follows (with reference to the paylines and payout table of FIG. 4): (i) 10.00 was won based on the presence of three "C" symbols (the "W" in the first reel being counted as a "C" symbol) along payline 4A; (ii) 10.00 was won based on the presence of three "B" symbols (the "W" in the first reel being counted as a "B" symbol) along payline 4C; (iii) 20.00 was won as a result of four "A" symbols (the "W" in the first reel being counted as an "A" symbol) along payline 4B; (iv) 10.00 was won based on the presence of three "A" symbols (the "W" in the first reel being counted as an "A" symbol) along payline 4E; (v) 10.00 was won based on the presence of three "A" symbols (the "W" in the first reel being counted as an "A" symbol) along payline 4D; (vi) 10.00 was won based on the presence of three "B" symbols (the "W" in the first reel being counted as a "B" symbol) along payline 4D; (vii) 10.00 was won based on the presence of three "D" symbols (the "W" in the first reel being counted as a "D" symbol) along payline 4F; (viii) 10.00 was won based on the presence of three "C" symbols (the "W" in the first reel being counted as a "C" symbol) along payline 4G; (ix) 10.00 was won based on the presence of three "C" symbols (the "W" in the first reel being counted as a "C" symbol) along payline 4H; (x) 10.00 was won based on the presence of three "D" symbols (the "W" in the first reel being counted as a "D" symbol) along payline 4I; and (xi) 10.00 was won based on the presence of three "A" symbols (the "W" in the first reel being counted as an "A" symbol) along payline 4I.

No wager was deducted (as also indicated in area 504) for the implementation of the wild reel and cascade. In other embodiments, an additional wager may be charged for at least one of the implementation of the wild reel and the cascade. For example, in some embodiments a player qualifies to have at least one of the wild reel game mechanic and the cascade game mechanic applied to an otherwise qualifying outcome if the player had placed a maximum allowable wager or provided an additional requirement payment upon initiation of the original spin or at another required time in the game play.

In accordance with some embodiments, a wild reel only remains a wild reel (i.e., all symbol positions or visible symbol positions of the reel have placed or displayed thereon at least one wild symbol or other special symbol) for a single outcome, cascade, re-spin or other game event. Thus, if another cascade, re-spin or other game event is triggered based on an outcome which had comprised a wild reel, all the symbol positions of the reel comprising the wild reel are populated with replacement regular symbols (e.g., newly determined regular symbols which are determined at the time they are needed or regular symbols which had previously been determined as being available for use in the replacing of the symbols on the wild reel). In other embodiments, a wild reel may remain wild for more than one outcome determination, cascade or other game event (e.g., if a cascade is triggered as a result of an outcome comprising a wild reel, the other qualifying symbols in the symbol matrix may be replaced via the cascading game mechanic while the wild reel remains wild (i.e., the positions of the reel remain populated with at least one wild symbol). For purposes of the present example being illustrated in FIGS. 5A through 5F, the wild reel does not remain a wild reel beyond the single game outcome for which it is generated.

Figure 5E:
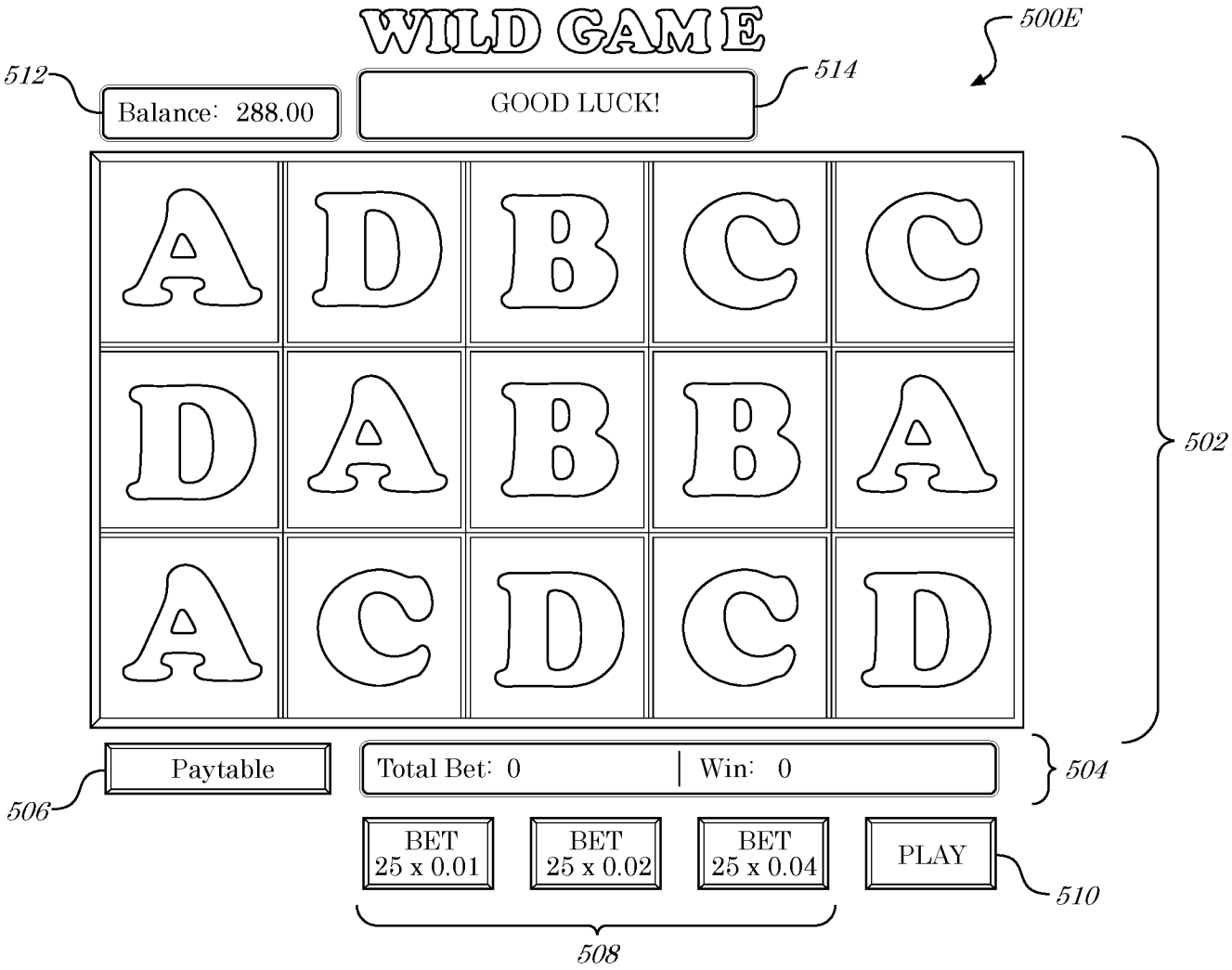

Turning now to FIG. 5E, screen shot 500E (which shows the progress in the game of the player since that shown in FIG. 5D). In accordance with some embodiments, the at least one wild symbol of a wild or qualifying reel is removed and replaced with regular symbols after payouts are determined based thereon (as was done with respect to FIG. 5D). Thus, the first reel in area 502 is populated with regular symbols (which may have been generated either upon determination of the original outcome for the reel spin which triggered the cascade(s) and/or wild reel or at any time in the game thereafter).

As further illustrated in area 502 of FIG. 5E, each of the symbols which were qualifying symbols in the outcome of FIG. 5D have been removed and replaced in accordance with the cascade game mechanic being utilized in the present non-limiting example. Since each of the symbols on the reel matrix in FIG. 5D was a qualifying symbol, FIG. 5E shows each of the symbols on the other reels has also been replaced with new regular symbols (which, again, may be generated either upon determination of the original outcome for the reel spin which triggered the cascade(s) and/or wild reel or at any time in the game thereafter). Thus, it so happens that each of the symbol positions in the symbol matrix of FIG. 5E is a replacement symbol for the symbols which appeared in the respective symbol positions as of FIG. 5D. As illustrated in area 504, no wager was deducted from the credit meter balance for this cascade and replacing, which is consistent with some embodiments. No payout was won as a result of the outcome output in FIG. 5D (i.e., none of the paylines included a winning combination of symbols). Thus, the cascade(s) initially triggered by the outcome of the spin illustrated in FIG. 5B has come to an end. If the player desires to do so, the player may initiated a new spin.

Figure 5F:
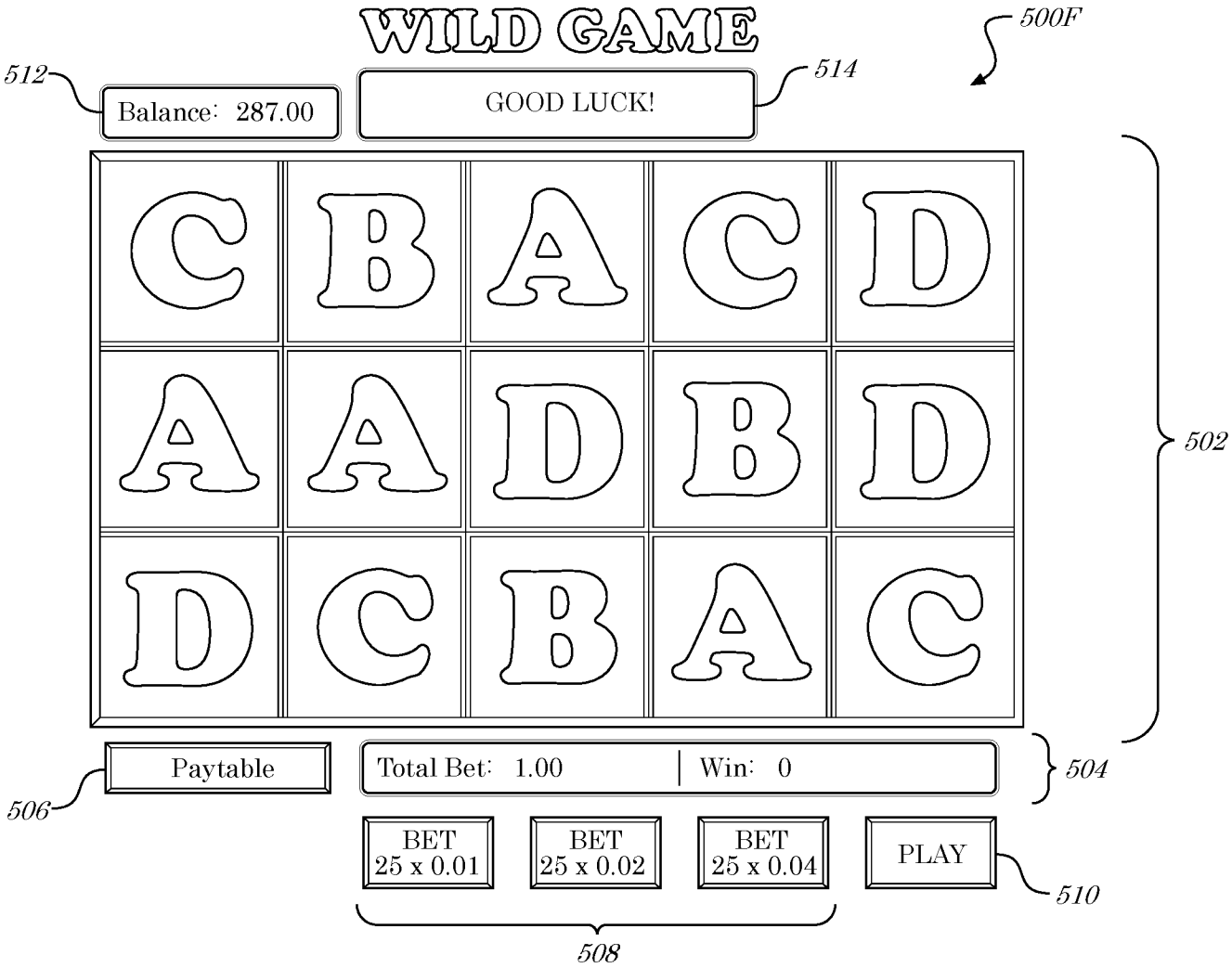

FIG. 5F illustrates screen shot 500F (which shows the progress in the game of the player since that shown in FIG. 5E). Screen shot 500F indicates that the player has indeed elected to initiate another spin by placing another bet of 1.00 credits. This is illustrated in area 504 and in the reduction in the credit balance show in area 512. Since none of the paylines 4A through 4I include a winning combination of symbols as a result of the spin, the player does not win any payout and no special game mechanics such as a cascade or a wild reel are triggered. Again, the player may elect to place another bet and initiate another wager (not shown).

As illustrated in FIGS. 5A through 5F, use of the wild reel game mechanic provides additional excitement and winning opportunities for a player (e.g., based on an original bet in accordance with some embodiments). The player in the example of these figures won 120.00 when the wild reel feature was triggered, which s(he) would not have won based merely on the original outcome of the spin output in FIG. 5B.

It should be noted that although FIGS. 5A through 5F illustrate a cascade game mechanic as being implemented along with the wild reel game mechanic, the cascade game mechanic is not necessary and in some embodiments may not be preferred. For example, the wild reel game mechanic may be implemented without the cascade game mechanic. In some embodiments, the wild reel game mechanic may be implemented alongside other types of game mechanics (e.g., free spins, reel re-spins, etc.).

Figure 6A:
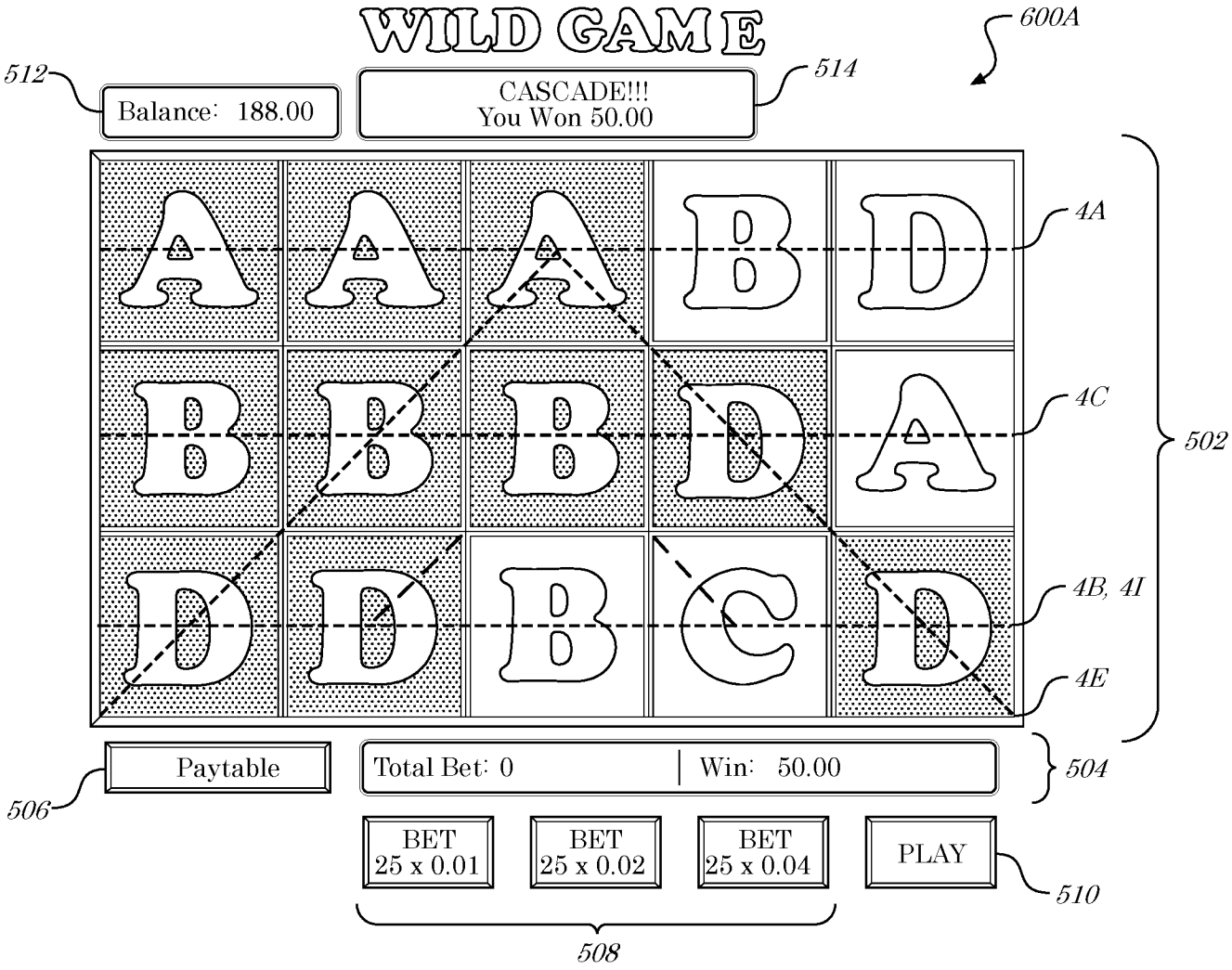
FIGS. 6A through 6B together illustrate one example embodiment of a game interface (e.g., a screen shot of an online game) for facilitating a game, as it is modified over the course of multiple events in the game, in a manner consistent with one or more embodiments described herein.
Figure 6B:
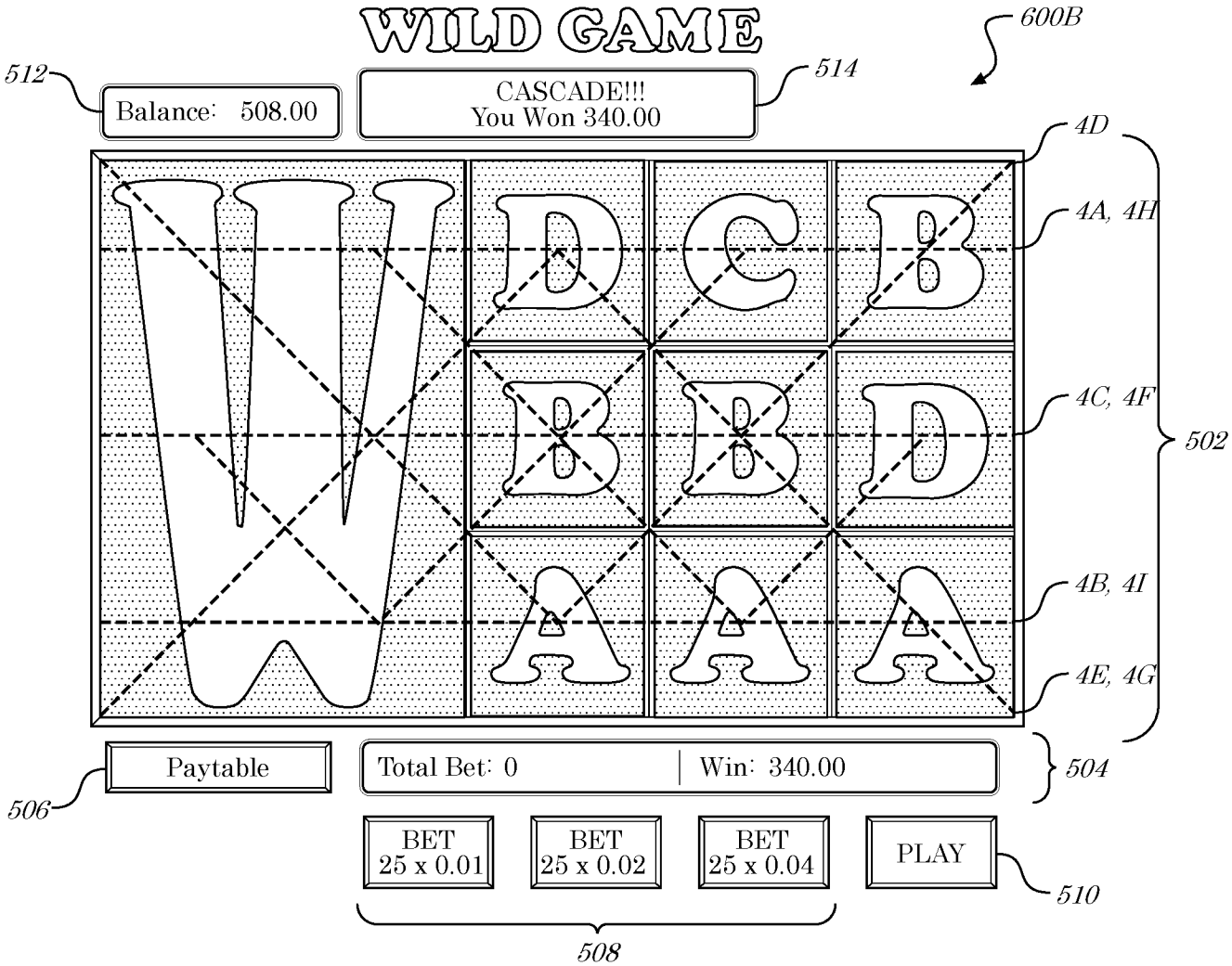

In some embodiments, replacement of regular symbols with wild symbols on reels (e.g., on qualifying reels) may further trigger additional events in a display (and, for example, additional bonuses). For example, in some embodiments, two adjacent reels on which wild symbols replace all the regular symbols (e.g., two adjacent qualifying reels are identified) may trigger a display to create a wild symbol image that takes up the entire area of both reels (e.g., the respective images of the qualifying adjacent reels are merged to show one unified image). Such an embodiment is illustrated in FIGS. 6A through 6B. In a three-reeled game, three adjacent reels on which wild symbols replace all the regular symbols may trigger a display to create a wild image that takes up the entire area of all three reels, etc. In some embodiments, one or more reels that are not adjacent to one another but on which wild symbols replace all the regular symbols may trigger a display to create multiple wild images that take up a single reel each.

Turning now to FIG. 6A, illustrated there is a screen shot 600A, which shows an alternate version of the progress in the game of the player since that shown in FIG. 5B. The screen shot 600A shows an alternate outcome which may result after the outcome illustrated in FIG. 5B (alternate to that illustrated in FIG. 5C). The only difference in the outcome shown in FIG. 6A compared to that shown in FIG. 5C is that the symbol in position "2" of the second reel is a "D" in FIG. 6A instead of the "C" that had occupied this position in FIG. 5C. This one difference in the symbols comprising the outcome makes a significant difference. First, the player wins an additional 20.00 credits (due to an additional 10.00 being won for the three "D" symbols now along payline 4B and the three "D" symbols now along payline 4I. Second, the second reel is now also a qualifying reel (because each of the symbols now shown on the second reel are each part of a respective winning combination of symbols, the predetermined condition for a reel to be a qualifying reel in accordance with an example embodiment). Thus, as a result of the alternate outcome illustrated in FIG. 6A, two adjacent qualifying reels have been determined.

Turning now to FIG. 6B, illustrated therein is a screen shot 600B, which shows an alternate version of the progress in the game of the player since that shown in FIG. 6A. In accordance with one embodiment, when two adjacent qualifying reels are identified, the game interface is modified such that each of the at least two adjacent qualifying reels appear as comprising a single symbol position which spans across the reels and a length of each reel instead of a plurality of symbol positions for each respective reel. Further, in accordance with one embodiment replacing the regular symbols of the qualifying reel with at least one wild symbol comprises replacing, on each of the at least two adjacent qualifying reels, each of the regular symbols with a single wild symbol which is output as appearing along a length and width of each of the at least two adjacent qualifying reels, wherein the single wild symbol is counted as a wild symbol for each payline of the plurality of paylines which passes through any symbol position which comprised the reels prior to the modification of the game interface (as had been described with respect to the qualifying reel of FIG. 5D for the single qualifying reel result). Thus, the "W" symbol comprising the wild symbol for purposes of the example game being described herein to illustrate some embodiments is shown in area 502 as being a single "W" symbol which is output across both the qualifying adjacent reels. It should be noted that the outcome illustrated in FIG. 6B is an alternate outcome to that illustrated in FIG. 5D. The outcome of FIG. 6B is the same as that for FIG. 5D with respect to the first reel and the third, fourth and fifth reel; it is different only in the sense that the second reel now effectively includes all wild symbols in each of its positions.

The total payout won as a result of the wild symbol being applied to each symbol position of each of the two qualifying reels is an additional 220.00 credits, in addition to the 120 credits won by the player as a result of the payouts described with respect to FIG. 5D (which continue to be relevant to the alternate outcome of FIG. 6B, but have the additional wild symbols of the second wild reel to be taken into account when calculating the total payout for the game event comprising the reel cascade and the two wild reels). The 220.00 additional win for the game event is derived as follows (with reference to the paylines and payout table of FIG. 4 and the payout derivation description provided above for FIG. 5D): (i) 10.00 was won based on the presence of three "B" symbols (the "W" in the first reel and the "W" in the second reel each being counted as a "B" symbol) along payline 4A; (ii) 10.00 was won based on the presence of three "D" symbols (the "W" in the first reel and the "W" in the second reel each being counted as a "B" symbol) along payline 4A; (iii) 10.00 was won based on the presence of four (instead of three) "B" symbols (the "W" in the first reel and the "W" in the second reel each being counted as a "B" symbol) along payline 4C; (iv) 10.00 was won based on the presence of three "D" symbols (the "W" in the first reel and the "W" in the second reel each being counted as a "B" symbol) along payline 4C; (v) 80.00 was won based on the presence of five (instead of four) "A" symbols (the "W" in the first reel and the "W" in the second reel each being counted as an "A" symbol) along payline 4B; (vi) 10.00 was won based on the presence of four (instead of three) "D" symbols (the "W" in the first reel and the "W" in the second reel each being counted as a "B" symbol) along payline 4D; (vii) 10.00 was won based on the presence of three "B" symbols (the "W" in the first reel and the "W" in the second reel each being counted as a "B" symbol) along payline 4E; (viii) 10.00 was won based on the presence of three "D" symbols (the "W" in the first reel and the "W" in the second reel each being counted as a "B" symbol) along payline 4E; (ix) 10.00 was won based on the presence of three "B" symbols (the "W" in the first reel and the "W" in the second reel each being counted as a "B" symbol) along payline 4F; (x) 10.00 was won based on the presence of three "A" symbols (the "W" in the first reel and the "W" in the second reel each being counted as an "A" symbol) along payline 4F; (xi) 10.00 was won based on the presence of three "A" symbols (the "W" in the first reel and the "W" in the second reel each being counted as an "A" symbol) along payline 4G; (xii) 10.00 was won based on the presence of three "B" symbols (the "W" in the first reel and the "W" in the second reel each being counted as a "B" symbol) along payline 4G; (xiii) 10.00 was won based on the presence of three "B" symbols (the "W" in the first reel and the "W" in the second reel each being counted as a "B" symbol) along payline 4H; (xiv) 10.00 was won based on the presence of three "A" symbols (the "W" in the first reel and the "W" in the second reel each being counted as an "A" symbol) along payline 4H; and (xv) 10.00 was won based on the presence of three "B" symbols (the "W" in the first reel and the "W" in the second reel each being counted as a "B" symbol) along payline 4A; (ii) 10.00 was won based on the presence of four (instead of three) "A" symbols (the "W" in the first reel and the "W" in the second reel each being counted as an "A" symbol) along payline 4I.

Thus, as a result of the second qualifying reel being introduced above and beyond the single qualifying reel in FIG. 5D, fifteen winning combinations of symbols were either created or modified, resulting in an additional win of 220.00 credits. This brought the player's credit balance up to 508.00 credits, as illustrated in area 512 of FIG. 6B.

Figure 9A:
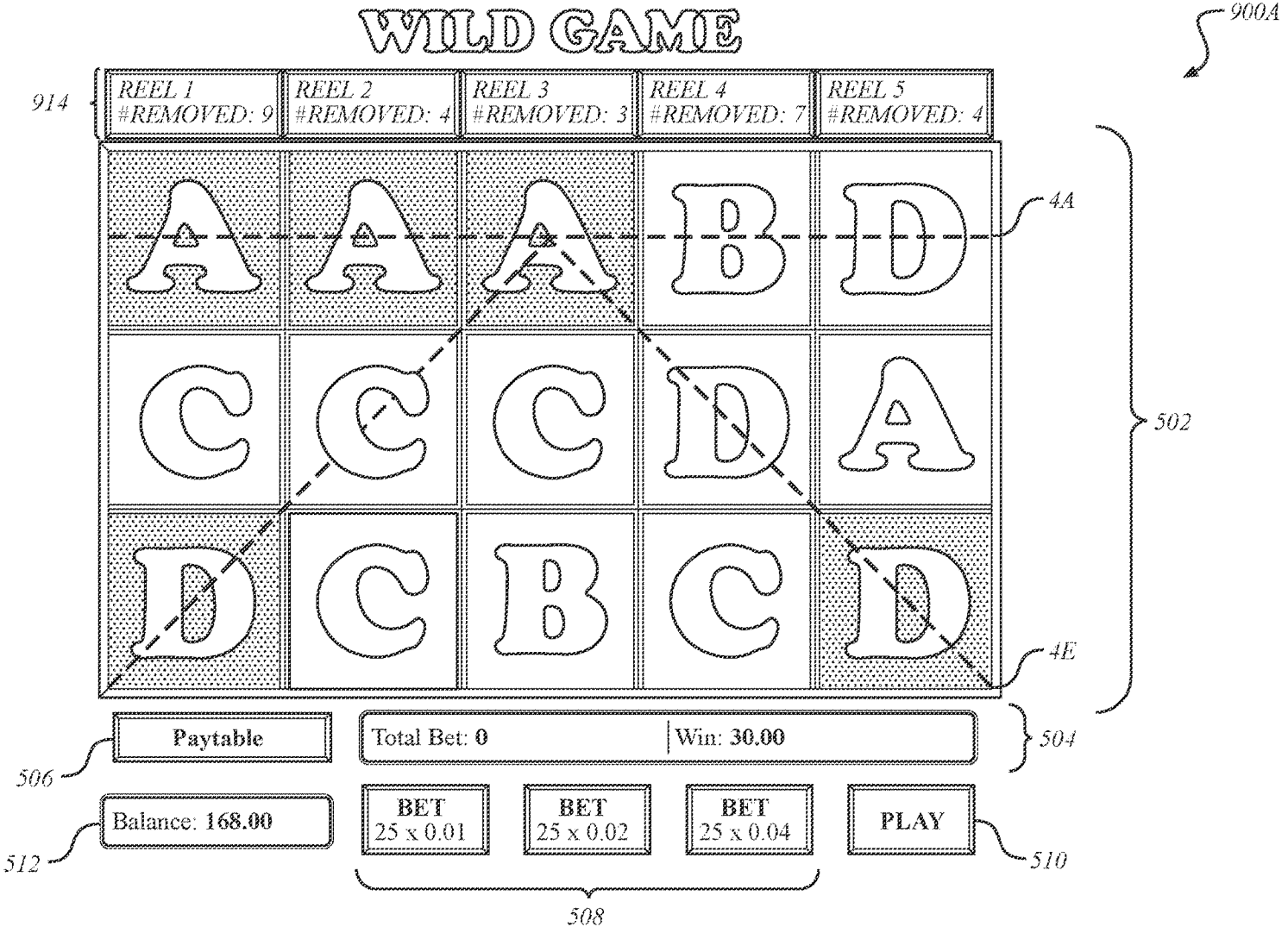
FIGS. 9A and 9B together illustrate one example embodiment of a game interface (e.g., a screen shot of an online game) for facilitating a game, as it is modified over the course of multiple events in the game, in a manner consistent with one or more embodiments described herein.
Figure 9B:
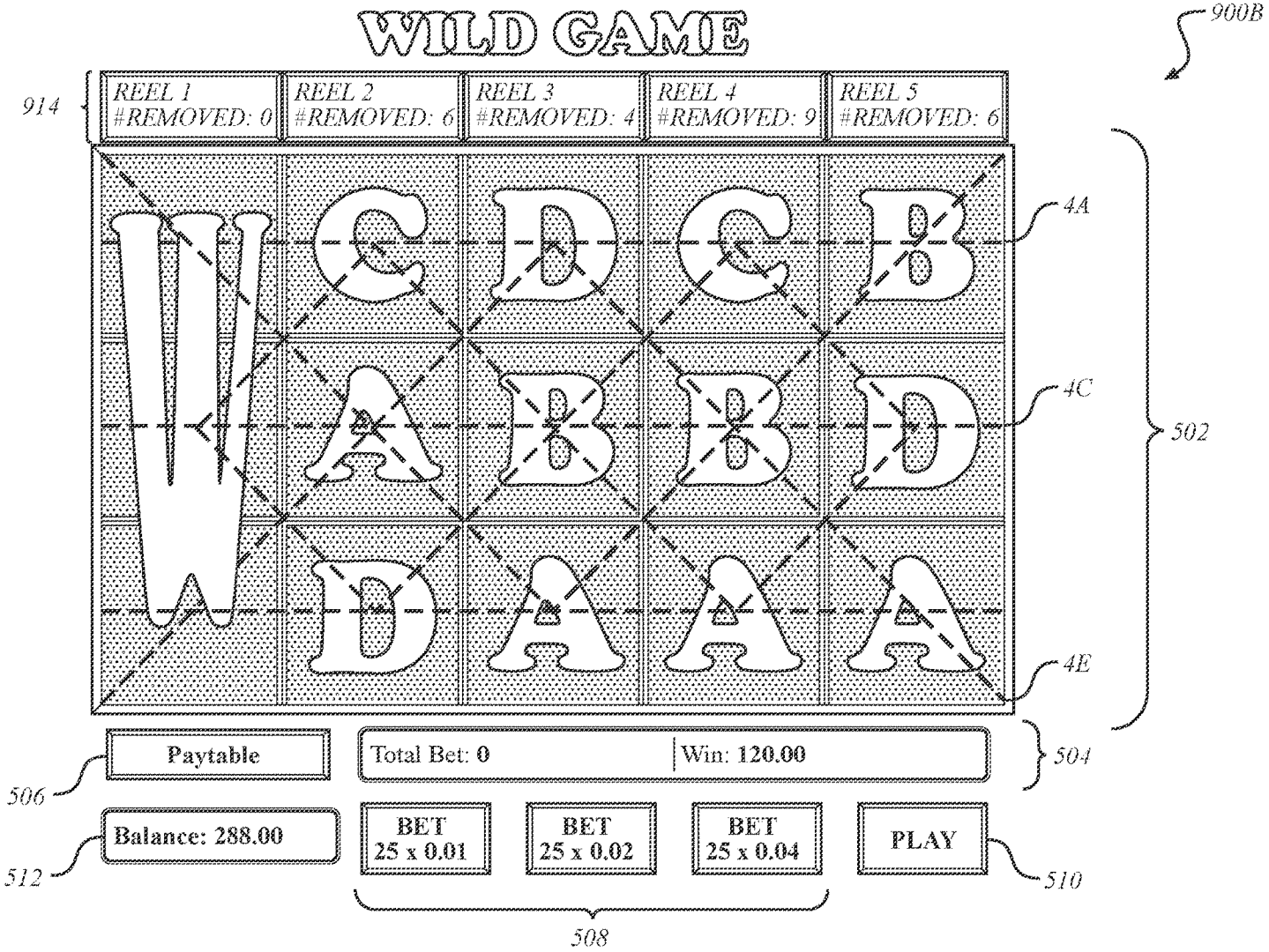

Turning now to FIG. 9A, illustrated there is a screen shot 900A (also referred to as GUI 900A), which shows an alternate version of a game in which an entire reel may be turned wild. In the embodiments of FIGS. 9A through 9B, the qualifying condition which may cause a reel to be considered a qualifying reel and thus have the symbols thereon replaced with one or more wild symbols is a removed symbol count (a count of symbols removed from that reel) being at least equal to a threshold count (also referred to as a threshold number herein). The screen shot 900A shows an alternate graphical user interface (GUI) which may be output to indicate a current status of a removed symbol count for each reel (alternate to that illustrated in FIGS. 5A through 5F and FIGS. 6A-6B). A difference between the GUIs shown in FIG. 9A and 9B compared to those shown in FIGS. 5A through 5F and FIGS. 6A-6B is that they include an additional area 914 above the reels, which area outputs a representation of a removed symbol count, or removed symbol count meter, for each reel. In accordance with some embodiments, the removed symbol count meter above each reel corresponds to the reel directly below it. All other elements in the GUI 900A of FIG. 9A and GUI 900B of FIG. 9B are similar to those described with respect to FIG. 5A through 5F and FIGS. 6A-6B and will not be described herein for purposes of brevity, other than to note that the "Balance" element 512 has been moved to be below, rather than above, the reel display area 502.

In accordance with some embodiments, the screen shots 900A and 900B illustrates a game with a cascade game mechanic, such as that illustrated in FIGS. 5A through 5F and FIGS. 6A-6B, which causes symbols to be removed from the reels during a cascade. FIG. 900A in particular shows a screen shot of the game after one or more cascades have already occurred (and thus the removed symbol count meters above the reels show the number of symbols that have already been removed during the cascades that already occurred). It may be assumed, for purposes of a non-limiting example, that the threshold number for causing a reel to be a qualifying reel is ten (10) and that the same threshold number applies for all reels. In some embodiments, the threshold number may also be displayed in a GUI having the removed symbol count meters (e.g., the removed symbol count may be depicted as 9/10 or "9 of 10" for Reel 1, 4/10 or "4 of 10" for Reel 2, etc. in the embodiment of FIGS. 9A and 9B). Displaying the threshold number may be particularly helpful in embodiments in which different threshold numbers are applied to different reels. As can be appreciated from reviewing the information depicted in FIG. 9A, at the time of the screen shot 900A, Reel 1 is very close to becoming a qualifying reel because there have been nine (9) symbols removed from that reel during the current cascade mechanic, out of the ten (10) symbols needed for the reel to become a qualifying reel. As also depicted in FIG. 9A, there are two additional symbols on Reel 1 (the "A" in position 0 and the "D" in position 2) that are part of winning combinations currently displayed on the screen that will be removed as a result of the player being paid for these winning combinations. This is in accordance with one embodiment described herein, in which symbols that are part of winning outcomes are removed from the reel and trigger another cascade (of course any game mechanic which causes symbols to be removed may be utilized and the embodiments described herein are not dependent on any specific methodology for determining whether/which symbols should be removed from a reel).

Turning now to FIG. 9B, illustrated therein is a screen shot 900B, which shows the progress in the game of the player since that shown in FIG. 9A. In particular, screen shot 900B shows that Reel 1 has become a qualifying reel as a result of the two symbols "A" and "D" having been removed (as described above with respect to FIG. 9A), thus resulting in the number of removed symbols having exceeded ten (10). The removed symbol count for Reel 1, as illustrated in area 914 of screen shot 900B, has been reset to zero (0), in accordance with some embodiments. In other embodiments, instead of being reset to a default number, the running count of removed symbols for a reel that is determined to be a qualifying reel may be continued but the threshold number for that reel may be increased (e.g., to double or more of the original threshold number). In some embodiments, the threshold number may be reset to some default number other than zero. As can be appreciated from a review of the information displayed in GUI 900B, the removed symbol counts for the other Reels 2-5 have also been updated to reflect the number of symbols removed from each respective reel as a result of the cascade that occurred between the screen shot 900A and 900B. GUI 900B additionally shows the many additional winning outcomes that have been generated as a result of the cascade that occurred between screen shot 900A and 900B and the placement of the wild symbol along all of the symbol positions of Reel 1.

It should be noted that although the embodiments of FIGS. 5A through 5F, FIGS. 6A through 6B and FIGS. 9A through 9B are described as replacing all symbols on a qualifying reel with a wild symbol which is equivalent to any of the regular symbols, in other embodiments another type of special symbol may be used to replace the regular symbols on a qualifying reel. For example, a modified wild symbol which may replace a subset of regular symbols but not all regular symbols may be used. In another embodiment, one or more scatter symbols may replace the regular symbols on a qualifying reel. Other examples of special symbols which may replace the regular symbols on a qualifying reel in accordance with the embodiments described herein include, without limitation: (i) a bonus round triggering symbol; (ii) a multiplier symbol which multiplies at least one payout for a player; (iii) a collection symbol which may be collected and used by the player for one or more benefits in a primary or bonus game; and (iv) a bonus symbol usable in a bonus round which may enhance a feature, mechanic, payout or opportunity for a player. It should further be noted that the wild reel embodiments described herein may be implemented in a primary game or a bonus round or feature of a game.

Example Processes

Figure 7:
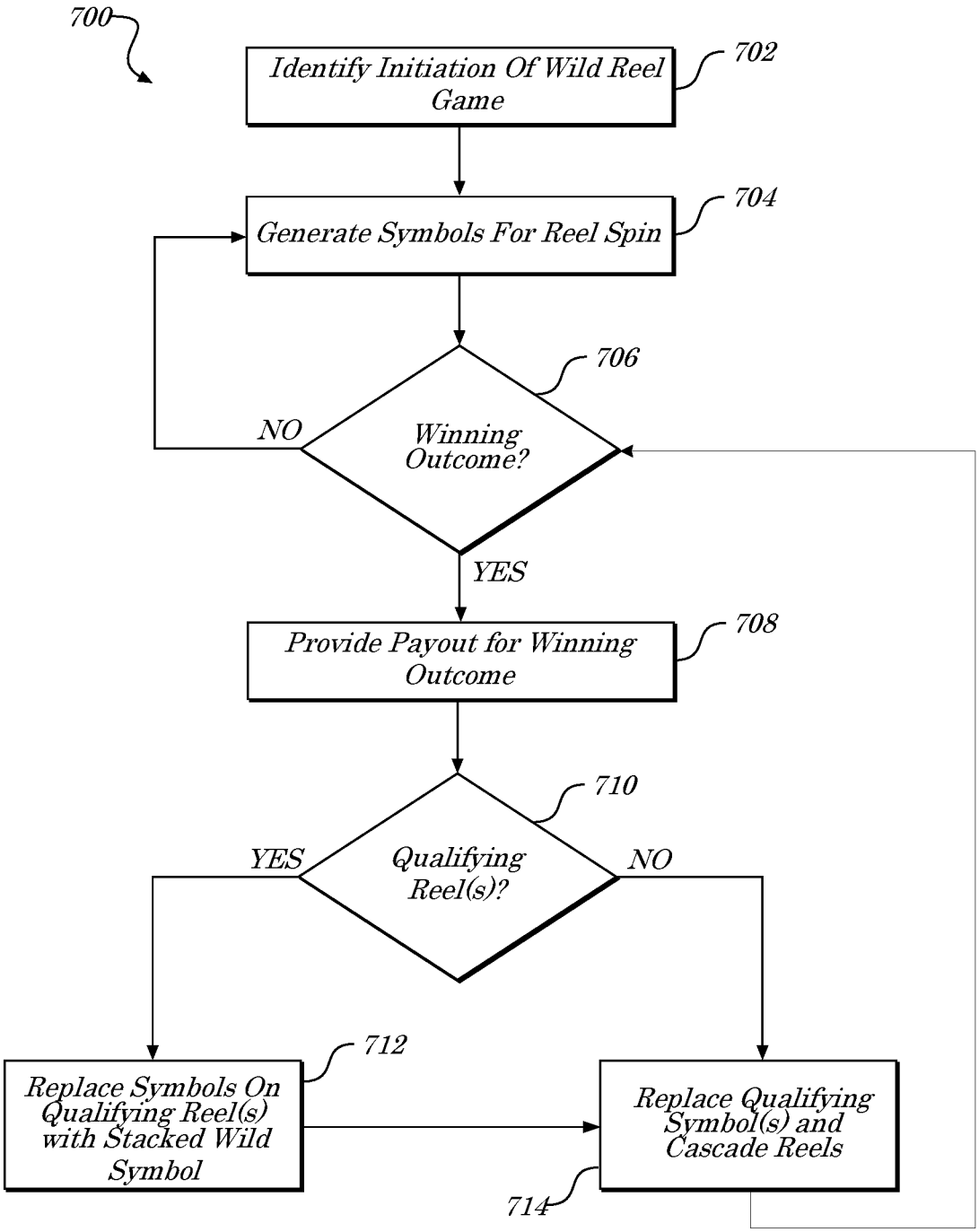
FIG. 7 is a flowchart illustrating a process according to one or more embodiments described herein.
Figure 8:
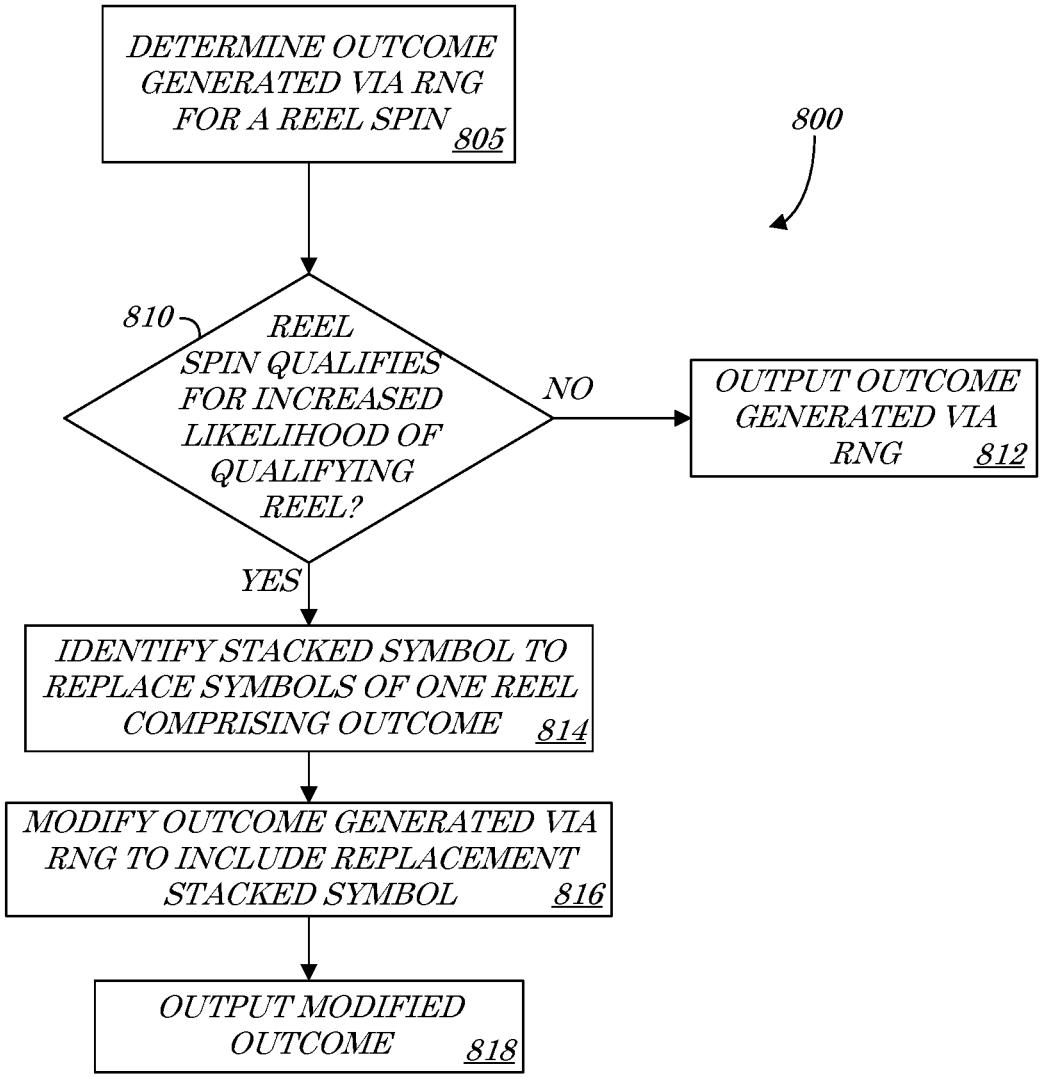
FIG. 8 is a flowchart illustrating a process according to one or more embodiments described herein.
Figure 10:
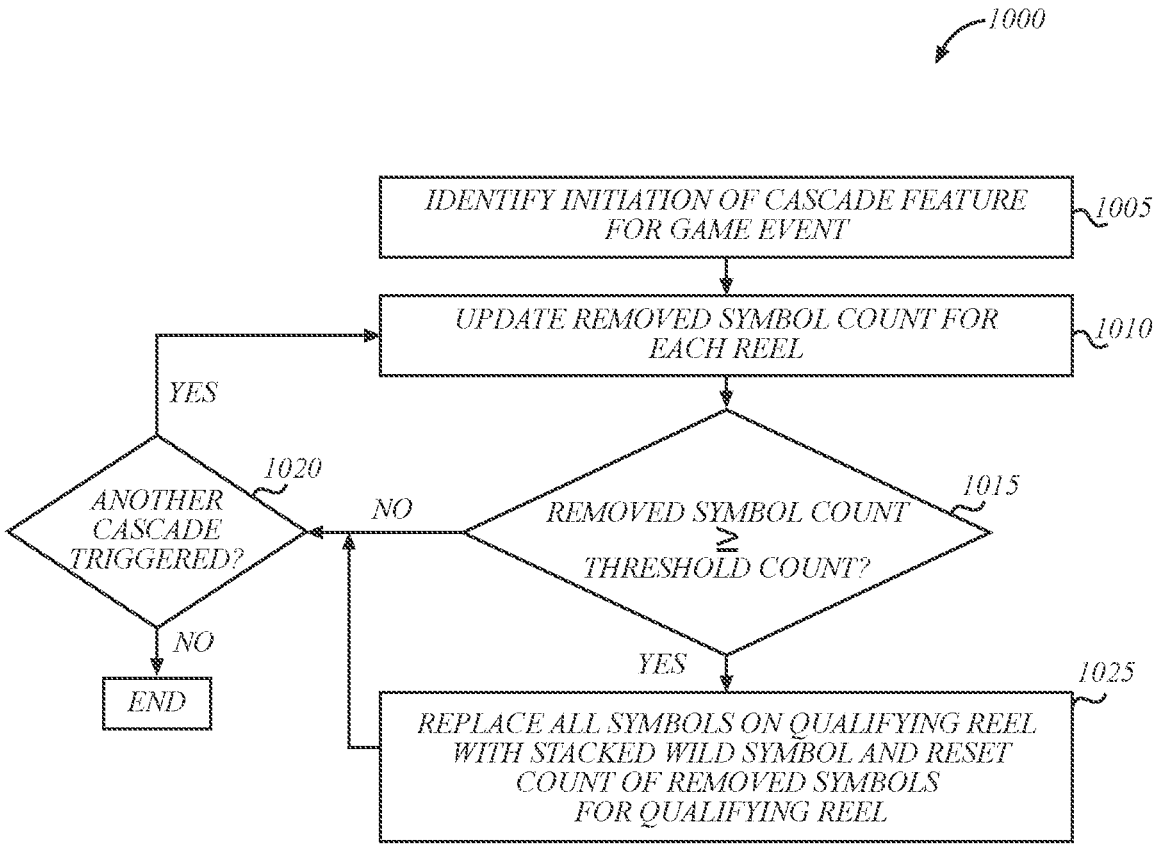
FIG. 10 is a flowchart illustrating a process according to one or more embodiments described herein.

Turning now to FIGS. 7, 8 and 10, illustrated therein are respective processes 700 (FIG. 7), 800 (FIG. 8) and 1000 (FIG. 10) for implementing some of the embodiments described herein. The processes 700, 800 and 1000 may comprise respective processes for implementing the wild reel features described herein, such as determining whether one or more reels comprises a qualifying reel as a result of an outcome or as a result of a removed symbol count reaching a threshold number and modifying a game interface to output at least one wild symbol (or other special symbol) on the qualifying reel(s). At least one of the processes 700, 800 and 1000 may be performed, for example, by at least one of a server device operable to facilitate an electronic (e.g., online) game and/or a player device enabling a player to play the electronic (e.g., online) game. For example, at least one of the processes 700, 800 and 1000 may be performed by at least one of (i) a player device 102 (FIG. 1); (ii) a game server 110 (FIG. 1); (iii) a player device 202 (FIG. 2); (iv) a game server 210 (FIG. 2); and (v) apparatus 300 (FIG. 3). It should be noted that, with respect to at least one of FIG. 7, FIG. 8 and FIG. 10, additional and/or different steps may be added to those depicted and that not all steps depicted are necessary to any embodiment described herein. Rather, the processes 700, 800 and 1000 are respective example processes of how some embodiments described herein may be implemented, and should not be taken in a limiting fashion. A person of ordinary skill in the art, upon contemplation of the embodiments described herein, may make various modifications to at least one of the process 700, 800 and 1000 without departing from the spirit and scope of the embodiments in the possession of applicants.

Turning now to FIG. 7 in particular, process 700 begins in step 702 with identifying that a game comprising the wild reel (i.e., qualifying reel) feature has been initiated (e.g., a player has placed a bet and initiated a game event, such as a reel spin). In step 704 the symbols for the reel spin are generated. In some embodiments, step 704 may comprise determining the symbols to output in a symbol matrix based on a random number, other result or instruction from an outcome determination process (which outcome determination process may be performed by the same device performing step 704 or another device which transmits the outcome, indication of outcome or instruction for outputting the outcome to the device performing step 704). For example, step 704 may comprise determining which regular symbol (or other special symbol utilized in the game) to place in each symbol position of the symbol matrix comprising the game. In step 706, it is determined whether the outcome of the spin (i.e., the symbols placed into the symbol matrix as the outcome of the reel spin) include any winning outcomes. For example, it may be determined whether any winning combinations of symbols are located along any of the paylines (or active paylines, depending on the embodiment) of the game interface. In some embodiments, step 706 may be performed essentially simultaneously or as part of step 704.

If it is determined, in step 706, that a winning combination of symbols or a winning outcome is not a result of the present game event or reel spin, the process 700 returns to step 704 and a new outcome is determined. This is presuming a new wager has been placed by the player and thus a new reel spin has been requested; otherwise the process 700 may end.

If it is determined, in step 706, that a winning combination of symbols is present in the outcome determined in step 704, the appropriate payout(s) for each of the winning combinations are provided. For example, a credit meter balance is increased based on the payout(s). A message may also be output to a player of the game, informing him/her of the total payout won as a result of the outcome.

It is then determined, in step 710, whether any of the reels are qualifying reels as a result of the outcome determined in step 704. In accordance with one embodiment, determining whether a reel is a qualifying reel comprises determining whether a characteristic of the reel satisfies one or more predetermined conditions of a qualifying reel. For example, the characteristic of the reel may be that each symbol on the reel (or each symbol on a visible portion of the reel) has placed, populated or displayed thereon a symbol that is part of a winning combination of symbols. The example embodiment of FIGS. 5C and 5D comprises such an embodiment: since each symbol position of the first reel in FIG. 5C included a symbol that was part of a respective winning combination, the first reel was determined to be a qualifying reel). In another example, the characteristic of the reel may be that each symbol on the reel (or each symbol on a visible portion of the reel) has placed, populated or displayed thereon a symbol that is part of an outcome of a payline which corresponds to a payout (i.e., the outcome of the payline comprises a winning combination of symbols but the symbol on the reel, which being part of the outcome of the payline, is not necessarily part of the winning combination of symbols). In yet another example, the characteristic of the reel may be that the paylines passing through the reel qualify for payouts such that the total payout amount of the paylines is at least a predetermined amount. Other examples of predetermined conditions which, if satisfied by a characteristic of a reel, would cause the reel to be determined to be a qualifying reel would be recognized by a person of ordinary skill in the art upon a review of the present disclosure.

If one or more of the reels are determined to be qualifying reels, the process continues to step 712. In step 712, each of the symbols on the qualifying reel(s) is replaced with at least one special symbol, such as wild symbol which may be considered to be equivalent (or functionally equivalent) to one or more regular symbols of the game, depending on the embodiment. In accordance with one embodiment, step 712 may comprise removing the regular symbols from each of the symbol positions of the qualifying reel(s) and replacing each with a respective wild or other special symbol. In another embodiment, such as those illustrated in FIGS. 5D and 6B, step 712 may comprise modifying the game interface such that rather than individual wild symbols (or other special symbols) being placed in each of the symbol positions of the qualifying reel(s), the individual symbol positions are replaced, modified or morphed into a single larger symbol position which takes up essentially the same area or space on the display as the individual symbol positions of the reel did and a single wild symbol (or other special symbol) is displayed or placed thereon. The process 700 then continues to step 714. If it is determined, in step 710, that there are no qualifying reel(s) as a result of the outcome determined in step 704, the process 700 also continues to step 714.

In accordance with one embodiment, the process 700 is for a game which includes a cascading reel feature in addition to the wild reel feature (as illustrated in FIGS. 5A through 5F). Thus, in step 714 any qualifying symbols on reels other than the qualifying reel(s) identified in step 710 are also removed and replaced with different symbols (e.g., different regular symbols). Once the qualifying symbols are replaced via a reel cascade (e.g., with symbols from positions immediately above the symbol position in which the removed qualifying symbol was located), the process 700 returns to step 706. It should be understood that the cascading reel feature is not necessary to any embodiment described herein, In some embodiments, a game may include the wild reel feature (in which each of the symbols on a qualifying reel are replaced with at least one special symbol such as a wild symbol) but not the cascading feature. In such an embodiment, process 700 may omit step 714 such that the process returns from step 712 to step 706. In step 706 it is determined whether any additional winning outcomes or winning combinations of symbols were created as a result of the qualifying reel symbol positions being populated with the at least one wild symbol (or other special symbol) and/or the cascade feature (if such a feature is implemented). The steps 708 through 712 are then repeated to evaluate the outcome determined as a result of the wild reel and/or the cascade.

It should be noted that, in accordance with one embodiment, if a qualifying reel is identified and the symbols thereon are replaced with at least one wild symbol (or other special symbol), the wild symbol(s) on the qualifying reel may only be maintained for a single outcome (the outcome generated as a result of the wild symbol(s) replacing the symbols on the qualifying reel(s) and the cascade feature (if it is implemented)). In such an embodiment, process 700 may further include a step of determining (e.g., after step 708) whether a qualifying reel had previously been determined in a preceding evaluation (the symbols on the qualifying reel having been replaced with at least one wild symbol) and, if so, replacing the at least one wild symbol (or other special symbol) on that reel with a respective regular symbol for each of the positions of that reel. In embodiments in which the interface had been modified such that the qualifying reel was output as a single symbol position having a wild symbol represented as a graphic displayed over the area of the single symbol position, this step may further comprise modifying the interface such that the reel previously identified as a qualifying reel is once more output as having the same plurality of symbol positions as the other non-wild reels of the interface (and placing a respective regular symbol on each of such symbol positions).

Turning now to FIG. 8, illustrated therein is a process 800 which is consistent with at least some embodiments described herein. The process 800 may be utilized to modify or alter an outcome of a spin or other game event before it is displayed to a player (e.g., modify it from that determined based on another process, such as a process which uses an RNG to determine an outcome for a game event based on a random or pseudo-random basis). In one embodiment, process 800 may be performed while the reels are spinning (or while a display indicates another type of game outcome as in the process of being resolved but not yet conclusively output). In accordance with one embodiment, the effect of process 800 may be to modify the symbols to be displayed on the visible symbol positions at the completion of the spin or other game event. Applicants have recognized that it may, in some embodiments, be desirable to increase the chances of a qualifying reel for a spin (e.g., increase the likelihood that all the symbols of a particular reel are part of winning combinations, such that the regular symbols of the reel will be replaced with wild symbols after the completion of the spin).

Process 800 begins with step 805, where it a preliminary outcome for a reel spin (e.g., an outcome determined via an RNG-driven process, also referred to as "the first process" herein) is determined. For example, such an outcome (or a random number usable for determining such an outcome) may be received from a remote server device by a player device or by a game server from a remote server device (as described with respect to FIGS. 1 and 2, respectively).

Once the outcome preliminarily slated to be the outcome for the current spin or other game event is determined, in step 810 it is determined whether the current reel spin (for which the outcome in step 805 was determined) qualifies for an increased likelihood that a result of the reel spin is a reel being a qualifying reel. In one embodiment, this determination may comprise a determination, of whether a stack of symbols should be placed on a reel as part of the outcome (e.g., the same symbol appearing in all positions visible to the player on a particular reel) or whether a stacked regular symbol should replace the symbols which are otherwise slated to appear on a given reel as a result of the first process. This determination may be based, for example, on a history of outcomes for at least one of particular session, player and/or period of time (e.g., the last X outcomes output for the current player or in the current session). For example, if it is determined that the player has not received an outcome which triggered a wild reel in the last X spins, it may be determined that the likelihood of the player receiving such an outcome should be increased for the current spin. In some embodiments, the second parallel process for determining whether a stacked symbol should be placed on a reel may comprise using a weighted distribution model. For example, the symbol comprising the stacked symbol may be assigned to the reel based on a weighted distribution (e.g., weighted to symbols which are more likely to a reel being determined to be qualifying reel).

If it is determined that the current spin does not qualify for an increased likelihood of a qualifying reel, the process 800 continues to step 812 in which the outcome determined in step 805 is output in a normal fashion. If, on the other hand, it is determined in step 810 that the current spin does qualify for an increased likelihood of a qualifying reel, process 800 continues to step 814.

In one embodiment, a process such as process 800 (also referred to as "the second process" herein) may further comprise determining which particular symbol (or subset of symbols from which the particular symbol is to be selected) is to be used as the stacked symbol. In one embodiment, the stacked symbol to replace the regular symbols otherwise slated to appear on the reel may be predetermined (e.g., it is always the same symbol that is output as the stacked symbol if it is determined that a stacked regular symbol is to replace the regular symbols otherwise slated to appear on the reel, in order to increase the likelihood that the reel will be determined to be a qualifying reel as a result of the outcome). In such an embodiment, step 814 may simply comprise selecting the predetermined symbol. In another embodiment, the second process may further comprise determining which regular symbol of a plurality of regular symbols is to be the stacked symbol. Such a determination may be based on, for example and without limitation, at least one of (i) a pseudo-random process, (ii) a weighted process; (iii) a history of outcomes achieved in a current gaming session (or by the player currently playing the game in the last X game events), and (iv) the other regular symbols of the outcome determined by the first process that are to appear on the other reels of the game interface. In this latter embodiment, step 814 may comprise selecting the regular symbol to use as a stacked symbol from the plurality of available regular symbols.

For example, assuming in a fruit-themed slot game that the result of a first process (e.g., an RNG-driven process for determining an outcome of a game event) is that the symbols "cherry" should appear on the "0" position of a particular reel, the symbol "apple" should appear on the "1" position of the particular reel and the symbol "banana" should appear on the "2" position of the particular reel, the second parallel process may comprise determining whether these symbols should be replaced with a "stacked" symbol. Determining whether a stacked symbol should replace the symbols otherwise slated to appear on the positions of a real may comprise determining whether each of the "0", "1" and "2" positions of the 3-position reel should be made to have the same symbol appear at the completion of the spin. Placing the same symbol on each position of a reel may increase the likelihood that the reel is determined to be a qualifying reel as a result of the spin, particularly if the symbol selected to be the stacked symbol is one that is common to a plurality of winning combinations of symbols.

In one embodiment, the stacked symbol may be selected to be a symbol that is common to a plurality of winning combinations. Assume, for example, that the symbol "cherry" is a symbol that appears in many winning combinations. Placing a stacked "cherry" symbol on the reel may thus increase the chances of the reel being determined to be a qualifying reel. Accordingly, in the "cherry-orange-banana" example, replacing each of the "orange" and "banana" symbols with a respective "cherry" symbol (i.e., placing a stacked "cherry" symbol on the reel) may increase the likelihood that the effected reel is determined to be a qualifying reel at the end of the spin.

Once the regular symbol to be used as the replacement stacked symbol for a given reel is identified in step 814, the outcome determined in step 805 is modified to include this stacked symbol (step 816). It should be noted that in some embodiments process 800 may include an additional step of determining which reel or column of the game interface the stacked symbol is to be placed on. Once a modified outcome is determined by replacing the stacked regular symbol determined in step 812 with the outcome determined in step 805 (e.g., replacing the regular symbols which had been slated, in accordance with the outcome of step 805, to appear on the reel being modified with the stacked symbol determined in step 812), the modified outcome is output to the player in step 818 as the outcome of the current spin. In some embodiments, the player may be completely unaware of the modification of the outcome and the modification may be done in a manner which is transparent to the player.

In some embodiments, the second process for determining whether a stacked symbol should be placed on a reel (and the result of this second process combined with the result of the first process for determining an outcome of the spin) may be executed independently for each reel for a given spin. In some embodiments, once a result of the first process (for determining an outcome of the spin) is determined and a result of the second process (for determining whether a stacked symbol should be placed on a reel and, if so, which symbol), the results may be combined to determine the final outcome of the spin that should be displayed to a player via a game interface as the reels stop spinning.

Thus, in accordance with some embodiments, systems, methods and articles of manufacture provide for placing wild symbols in a game by:

(a) providing a game interface comprising a plurality of symbol positions, the plurality of symbol positions arranged in a plurality of rows and a plurality of columns, each column of the plurality of columns representing a reel of a slot-machine type game, wherein the game further comprises a plurality of paylines, each payline comprising a plurality of symbol positions such that a winning outcome comprises a predetermined combination of symbols being displayed in the symbol positions comprising a payline of the plurality of paylines upon a resolution of a game event;

(b) identifying, upon a resolution of a first game event and for each payline of the game, whether symbols displayed in the symbol positions comprising the payline comprise a winning outcome;

(c) causing, for each identified winning outcome, a corresponding payout to be awarded to a player currently playing the game;

(d) determining, for the particular game event and for a particular column of the game interface, that each respective symbol in each symbol positions of the column is part of a winning combination identified in (b), thereby identifying a qualifying reel; and (e) replacing, on the qualifying reel, each of the symbols with a wild symbol.

In accordance with some embodiments, the systems, methods and articles of manufacture further provide for re-determining, for each payline of the game after the replacing and prior to an initiation of a subsequent spin (e.g., and only if any reel symbols were replaced with wild symbols), whether the symbols displayed in symbol positions comprising each respective payline, which may now include wild symbols, correspond to a winning combination of symbols; causing, for each winning combination of symbols identified in the re-determining, a corresponding payout to be awarded to the player; and re-evaluating, after the replacing, whether a reel of the plurality of reels consists of symbols which are each part of a winning combination, thereby re-evaluating whether any reel comprises a qualifying reel after the replacing.

In accordance with some embodiments, the systems, methods and articles of manufacture further provide for (i) determining an initiation of a subsequent spin of the reels; and (ii) maintaining for at least the subsequent spin, on the qualifying reel, each of the wild symbols which replaced the regular symbols of the reel.

In accordance with some embodiments, the systems, methods and articles of manufacture further provide for (i) determining an initiation of a subsequent spin of the reels;

and (ii) maintaining for at least the subsequent spin, on the qualifying reel, each of the wild symbols which replaced the regular symbols of the reel.

Turning now to FIGS. 9A-9B, illustrated therein

Turning now to FIG. 10, illustrated therein is a flow diagram of an example process 1000. Process 1000 is a process that is consistent with embodiments in which a qualifying event is determined based on a removed symbol count for each reel. As described herein, in some embodiments a reel may be determined to be (or identified as) a qualifying reel if a number of symbols removed from the reel (or replaced on the reel) during a game event, during a game feature (e.g., during a cascade feature) of a game event or during some other predetermined period of time (e.g., during a current player's playing session) reaches or exceeds a threshold number. In one embodiment, a running count of removed symbols is initiated upon a beginning of a predetermined game feature or other qualifying condition (e.g., when a game goes into a cascade feature).

In step 1005, it is determined that the cascade feature of a game has been initiated (e.g., a player has obtained a game outcome that triggers the cascade feature). In the embodiment of process 1000, it is the initiation of a cascade feature that triggers the maintaining and updating of the running count of removed symbols. In other embodiments, another game event or other type of event may trigger the initiation of the removed symbol counts. For example, in some games removal of symbols may be part of the primary game and the removed symbol count feature described herein may be incorporated as an additional feature of such a game, providing an opportunity for the player to earn a stacked wild symbol on one of the reels. In accordance with the embodiment of FIG. 10, once it is determined that the cascade feature has been initiated, the removed symbol count for each reel may be initiated. In some embodiments, this may comprise beginning the tracking of the number of symbols removed from each reel as a result of each cascade and updating an internal and/or external removed symbol count for each reel. In some embodiments, this may also comprise activating or outputting a graphical user representation of the removed symbol count meter for each reel (e.g., such as illustrated in area 914 of FIGS. 9A and 9B). For example, removed symbol count meters may be added to the graphical user interface (e.g., a running count may be displayed over each reel or to the side of the reels), a new graphical user interface may be output that includes the removed symbol count meters or previously grayed-out removed symbol count meters may be activated.

In step 1010, the removed symbol count for each reel is updated. This step may be performed, for example, upon a determination that a symbol has been removed from at least one reel (e.g., in response to a progression of a game or game mechanic, such as in response to the first cascade). Thus, if one symbol is removed from a reel, the removed symbol count for that reel is increased by one, if two symbols are removed from the reel, the removed symbol count for that reel is increased by two, etc. In accordance with some embodiments, this updating of the removed symbol counts may be performed simultaneously or essentially simultaneously for each reel, as the symbols are removed and prior to the next game event that may cause symbols to be removed (e.g., prior to the next cascade). In some embodiments, an animation may be displayed to illustrate a removed symbol "floating" or moving off a reel and towards the corresponding removed symbol count meter, disappearing from the screen as the removed symbol count meter is updated to reflect the addition of that removed symbol.

It should be noted that although the embodiments of FIGS. 9A-9B and FIG. 10 refer to each reel as having its own corresponding removed symbol count meter, such a one-to-one correspondence of reel-to-count is not required. For example, in some embodiments only a subset of the reels (e.g., one) may have an associated removed symbol count meter such that only the symbols removed from the reel(s) that have an associated removed symbol count meter are counted and can cause that reel to become a qualifying reel (in one embodiment, the player may be provided the opportunity to choose which reel(s) the removed symbol count meter(s) is to be associated with). In another example of an alternate embodiment, a single removed symbol count meter may be implemented for all the reels, such that symbols removed from any of the reels will cause the meter to be updated. In such embodiments, the threshold count that causes a reel to become a qualifying reel may be set relatively higher and there may be an additional mechanism for determining which reel is to be considered the qualifying reel once the threshold count is reached. For example, the last reel to contribute to the removed symbol count reaching or exceeding the threshold count may be determined to be the qualifying reel, the reel that will result in the player obtaining the most additional winning outcomes as a result of the special symbol(s) being placed on the qualifying reel may be selected as the qualifying reel, the player may be provided an opportunity to choose (e.g., at the beginning of the game or cascade feature) which reel is to be selected as the qualifying reel or one of the reels may randomly be selected to be the qualifying reel.

Turning again to FIG. 10, once the removed symbol count has been updated for each reel in step 1010, it is determined whether any of the removed symbol counts are equal to or exceed a corresponding threshold count (step 1015). It should be noted that, in accordance with some embodiments, the threshold count (also referred to herein as a "threshold number") may be the same for all reels while in other embodiments different reels may have different corresponding threshold counts. In some embodiments, step 1015 (or another step in process 1000) may comprise retrieving from a database or memory (or otherwise determining) the threshold count that the current value of each removed symbol count is to be compared to. The threshold count or threshold number that, once reached or exceeded in a removed symbol count, may be selected or set based on one or more factors. Examples of such factors include, without limitation: (i) the particular reel for which removed symbols are being tracked (e.g., different reels may have different threshold numbers associated therewith); (ii) an identity or characteristic of the player playing the game; (iii) a time and/or date on which the game is being played; (iv) a preference of the game manufacture or game operator (e.g., game operator may, at a time of its choosing, lower the threshold number to increase the chances that a reel may qualify as a qualifying reel); (v) a random determination by a processor of the game; (vi) a bonus or eligibility won or otherwise obtained by the player during play of the game; (vii) whether the player provided a fee or otherwise qualified for a particular threshold count; and (viii) a magnitude or frequency of wagers placed by the player.

If it is determined, in step 1015, that the removed symbol count for one or more reels is at least equal to the threshold count for that reel, the reel for which this condition is true is considered a qualifying reel. In accordance with some embodiments, once a reel is considered a qualifying reel the process 1000 proceeds to step 1025 and the symbols on the qualifying reel are replaced with a stacked wild symbol (e.g., one or more wild symbols, such that each position on that reel is considered to have positioned therein a wild symbol). Of course, as described herein, in some embodiments other benefits may be provided to a player for a reel determined to be a qualifying reel. Step 1025 also comprises resetting the removed symbol count for the qualifying reel to a default number (e.g., zero). In accordance with some embodiments, it may be possible for the same reel to be determined to be a qualifying reel more than once in a given game event or period of time for which removed symbols are being tracked and so the removed symbol count for that reel may continue to be tracked and updated as symbols are removed for that reel.

Once the stacked wild symbol is placed on the qualifying reel and the removed symbol count is resent for the reel, the process continues to step 1020. Similarly, if the answer to the query in step 1015 had been "no" then the process 1000 also continues to step 1020 without diverging to step 1025. In step 1020 it is determined whether another cascade has been triggered for the game event. This is to determined whether there is a potential for additional symbols to be removed from the reels and thus whether the removed symbol counts may need to be updated again for the game event (in embodiments in which a game mechanic other than a cascade may cause symbols to be removed, step 1020 may instead comprise determining whether that game mechanic has again occurred or is continuing, so as to determine whether the removed symbol counts should continue to be updated). If the answer to the query in step 1020 is "no" (e.g., the cascade or other game mechanic has ended and thus there is no further need to track the removed symbol counts for the reels at this time), then process 1000 ends. Otherwise, process 1000 returns to step 1010, in which step the removed symbol counts are updated as appropriate based on additional symbols that may be removed from one or more reels.

Rules of Interpretation

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

The Title (set forth at the beginning of the first page of this disclosure) is not to be taken as limiting in any way as the scope of the disclosed invention(s).

The term "product" means any machine, manufacture and/or composition of matter as contemplated by 35 U.S.C. § 101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "and/or", when such term is used to modify a list of things or possibilities (such as an enumerated list of possibilities) means that any combination of one or more of the things or possibilities is intended, such that while in some embodiments any single one of the things or possibilities may be sufficient in other embodiments two or more (or even each of) the things or possibilities in the list may be preferred, unless expressly specified otherwise. Thus for example, a list of "a, b and/or c" means that any of the following interpretations would be appropriate: (i) each of "a", "b" and "c"; (ii) "a" and "b"; (iii) "a" and "c"; (iv) "b" and "c"; (v) only "a"; (vi) only "b"; and (vii) only "c."

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device, component or article is described herein, more than one device, component or article (whether or not they cooperate) may alternatively be used in place of the single device, component or article that is described. Accordingly, the functionality that is described as being possessed by a device may alternatively be possessed by more than one device, component or article (whether or not they cooperate).

Similarly, where more than one device, component or article is described herein (whether or not they cooperate), a single device, component or article may alternatively be used in place of the more than one device, component or article that is described. For example, a plurality of computer-based devices may be substituted with a single computer-based device. Accordingly, the various functionality that is described as being possessed by more than one device, component or article may alternatively be possessed by a single device, component or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining, recognizing, and the like.

A "display" as that term is used herein is an area that conveys information to a viewer. The information may be dynamic, in which case, an LCD, LED, CRT, Digital Light Processing (DLP), rear projection, front projection, or the like may be used to form the display. The aspect ratio of the display may be 4:3, 16:9, or the like. Furthermore, the resolution of the display may be any appropriate resolution such as 480i, 480p, 720p, 1080i, 1080p or the like. The format of information sent to the display may be any appropriate format such as Standard Definition Television (SDTV), Enhanced Definition TV (EDTV), High Definition TV (HDTV), or the like. The information may likewise be static, in which case, painted glass may be used to form the display. Note that static information may be presented on a display capable of displaying dynamic information if desired. Some displays may be interactive and may include touch screen features or associated keypads as is well understood.

The present disclosure may refer to a "control system" or program. A control system or program, as that term is used herein, may be a computer processor coupled with an operating system, device drivers, and appropriate programs (collectively "software") with instructions to provide the functionality described for the control system. The software is stored in an associated memory device (sometimes referred to as a computer readable medium or an article of manufacture, which may be non-transitory in nature). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, Central Processing Unit (CPU) devices, computing devices, microcontrollers, digital signal processors, or like devices. Exemplary processors are the INTEL PENTIUM or AMD ATHLON processors.

The term "computer-readable medium" refers to any statutory medium that participates in providing data (e.g., instructions) that may be read by a computer, a processor or a like device. Such a medium may take many forms, including but not limited to non-volatile media, volatile media, and specific statutory types of transmission media. Non-volatile media include, for example, optical or magnetic disks and other persistent memory. Volatile media include DRAM, which typically constitutes the main memory. Statutory types of transmission media include coaxial cables, copper wire and fiber optics, including the wires that comprise a system bus coupled to the processor. Common forms of computer-readable media include, for example, a floppy disk, a flexible disk, hard disk, magnetic tape, any other magnetic medium, a CD-ROM, Digital Video Disc (DVD), any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read. The terms "computer-readable memory", "article of manufacture" and/or "tangible media" specifically exclude signals, waves, and wave forms or other intangible or non-transitory media that may nevertheless be readable by a computer.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as those described herein. In addition, the databases may, in a known manner, be stored locally or remotely from a device that accesses data in such a database. Furthermore, while unified databases may be contemplated, it is also possible that the databases may be distributed and/or duplicated amongst a variety of devices.

As used herein a "network" is an environment wherein one or more computing devices may communicate with one another. Such devices may communicate directly or indirectly, via a wired or wireless medium such as the Internet, LAN, WAN or Ethernet (or IEEE 802.3), Token Ring, or via any appropriate communications means or combination of communications means. Exemplary protocols include but are not limited to: Bluetooth™, Time Division Multiple Access (TDMA), Code Division Multiple Access (CDMA), Global System for Mobile communications (GSM), Enhanced Data rates for GSM Evolution (EDGE), General Packet Radio Service (GPRS), Wideband CDMA (WCDMA), Advanced Mobile Phone System (AMPS), Digital AMPS (D-AMPS), IEEE 802.11 (WI-FI), IEEE 802.3, SAP, the best of breed (BOB), system to system (S2S), or the like. Note that if video signals or large files are being sent over the network, a broadband network may be used to alleviate delays associated with the transfer of such large files, however, such is not strictly required. Each of the devices is adapted to communicate on such a communication means. Any number and type of machines may be in communication via the network. Where the network is the Internet, communications over the Internet may be through a website maintained by a computer on a remote server or over an online data network including commercial online service providers, bulletin board systems, and the like. In yet other embodiments, the devices may communicate with one another over RF, cable TV, satellite links, and the like. Where appropriate encryption or other security measures such as logins and passwords may be provided to protect proprietary or confidential information.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PROTOCOLS, ALGORITHMS, AND SOURCE CODE IN C, John Wiley & Sons, Inc. 2d ed., 1996, which is incorporated by reference in its entirety.

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

It will be readily apparent that the various methods and algorithms described herein may be implemented by, e.g., appropriately programmed general purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software. Accordingly, a description of a process likewise describes at least one apparatus for performing the process, and likewise describes at least one computer-readable medium and/or memory for performing the process. The apparatus that performs the process can include components and devices (e.g., a processor, input and output devices) appropriate to perform the process. A computer-readable medium can store program elements appropriate to perform the method.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present application.

What is claimed is:

1. A method for providing wild symbols in an electronic game, comprising:

(a) providing, by a game server, a game interface comprising a plurality of symbol positions, the plurality of symbol positions arranged in a plurality of rows and a plurality of columns, each column of the plurality of columns representing a reel of a slot-machine type game;

(b) outputting, by the game server, a first outcome for a first game event based on an initial wager;

(c) identifying, by the game server based on the first outcome and for each column of the game interface, a number of symbols (i) displayed in the symbol positions comprising the column and (ii) removed from the symbol positions as a result of a game feature of the first game event, wherein the removal is distinct from an initiation of a new game event and is part of the first game event;

(d) updating a respective removed symbol count corresponding to each column, by the game server and based on the number of symbols removed from the symbol positions of the corresponding column during the first game event;

(e) determining, by the game server and for a particular column of the plurality of columns, that the removed symbol count is at least equal to a threshold count, thereby identifying the particular column as a qualifying reel that is defined as the qualifying reel because the number of symbols removed from the particular column based on the first game event is at least equal to the threshold count; and (f) replacing, by the game server and on the qualifying reel, each of the symbols with at least one special symbol.

2. The method of claim 1, wherein the special symbol is a wild symbol which is substitutable, for purposes of determining a presence of a winning combination of symbols, for any regular symbol of the game.

3. The method of claim 1, wherein game feature is a cascade feature.

4. The method of claim 1, further comprising:

determining, for each column of the game interface, a threshold count.

5. The method of claim 1, further comprising:

identifying, by the game server, whether the first outcome is a winning outcome; and causing, by the game server and for each identified winning outcome, a corresponding payout to be awarded to a player currently playing the game.

6. The method of claim 5, further comprising:

identifying, by the game server, whether the replacing resulted in any additional winning outcomes to be created; and causing, by the game server and for each identified additional winning outcome, a corresponding payout to be awarded to the player.

7. The method of claim 6, further comprising:

replacing the at least one special symbol with regular game symbols once the determination of whether the replacing with the at least one special symbol resulted in any additional winning outcomes, wherein the replacing of the at least one special symbol does not affect the removed symbol count corresponding to the column on which the at least one special symbol is being replaced.

8. The method of claim 1, further comprising:

resetting, upon replacing, the removed symbol count corresponding to the qualifying reel to a default count.

9. The method of claim 1, further comprising:

causing the game interface to be modified such that the qualifying reel appears as comprising a single vertical symbol position instead of a plurality of symbol positions, and wherein the replacing comprises:

replacing, on the qualifying reel, each of the regular symbols with a single special symbol which is output as appearing along a length of the qualifying reel, wherein the single special symbol is counted as a special symbol for each payline of a plurality of paylines which passes through the qualifying reel.

10. A non-transitory computer-readable medium storing instructions executable by a processor, which instructions when executed by the processor cause the processor to:

(a) provide a game interface comprising a plurality of symbol positions, the plurality of symbol positions arranged in a plurality of rows and a plurality of columns, each column of the plurality of columns representing a reel of a slot-machine type game;

(b) output a first outcome for a first game event based on an initial wager;

(c) identify, based on the first outcome and for each column of the game interface, a number of symbols (i) displayed in the symbol positions comprising the column and (ii) removed from the symbol positions as a result of a game feature of the first game event, wherein the removal is distinct from an initiation of a new game event and is part of the first game event;

(d) update a respective removed symbol count corresponding to each column, based on the number of symbols removed from the symbol positions of the corresponding column during the first game event;

(e) determine, for a particular column of the plurality of columns, that the removed symbol count is at least equal to a threshold count, thereby identifying the particular column as a qualifying reel that is defined as the qualifying reel because the number of symbols removed from the particular column based on the first game event is at least equal to the threshold count; and (f) replace, on the qualifying reel, each of the symbols with at least one special symbol.

11. The non-transitory computer-readable medium of claim 10, wherein the special symbol is a wild symbol which is substitutable, for purposes of determining a presence of a winning combination of symbols, for any regular symbol of the game.

12. The non-transitory computer-readable medium of claim 10, wherein game feature is a cascade feature.

13. The non-transitory computer-readable medium of claim 10, wherein the instructions further cause the processor to:

determine, for each column of the game interface, a threshold count.

14. The non-transitory computer-readable medium of claim 10, wherein the instructions further cause the processor to:

identify whether the first outcome is a winning outcome; and cause, for each identified winning outcome, a corresponding payout to be awarded to a player currently playing the game.

15. The non-transitory computer-readable medium of claim 14, wherein the instructions further cause the processor to:

identify whether the replacing resulted in any additional winning outcomes to be created; and cause, for each identified additional winning outcome, a corresponding payout to be awarded to the player.

16. The non-transitory computer-readable medium of claim 15, wherein the instructions further cause the processor to:

replace the at least one special symbol with regular game symbols once the determination of whether the replacing with the at least one special symbol resulted in any additional winning outcomes, wherein the replacing of the at least one special symbol does not affect the removed symbol count corresponding to the column on which the at least one special symbol is being replaced.

17. The non-transitory computer-readable medium of claim 10, wherein the instructions further cause the processor to:

reset, upon replacing, the removed symbol count corresponding to the qualifying reel to a default count.

18. The non-transitory computer-readable medium of claim 10, wherein the instructions further cause the processor to:

cause the game interface to be modified such that the qualifying reel appears as comprising a single vertical symbol position instead of a plurality of symbol positions, and wherein the replacing comprises:

replace, on the qualifying reel, each of the regular symbols with a single special symbol which is output as appearing along a length of the qualifying reel, wherein the single special symbol is counted as a special symbol for each payline of a plurality of paylines which passes through the qualifying reel.

* * * * *